US011326616B2

(12) United States Patent
Wang et al.

(10) Patent No.: US 11,326,616 B2
(45) Date of Patent: May 10, 2022

(54) DISK-SHAPED FAN IMPELLER STRUCTURE

(71) Applicant: ASIA VITAL COMPONENTS CO., LTD., New Taipei (TW)

(72) Inventors: Te-Chung Wang, New Taipei (TW); Ming-Che Lee, New Taipei (TW); Min-Sheng Cheng, New Taipei (TW); Liang-Hsuan Yeh, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 16/727,919

(22) Filed: Dec. 27, 2019

(65) Prior Publication Data

US 2021/0199121 A1 Jul. 1, 2021

(51) Int. Cl.

| | |
|---|---|
| ***F04D 29/28*** | (2006.01) |
| ***F04D 29/66*** | (2006.01) |
| ***F04D 17/16*** | (2006.01) |

(52) U.S. Cl.

CPC ..... *F04D 29/281* (2013.01); *F04D 17/16* (2013.01); *F04D 29/666* (2013.01)

(58) Field of Classification Search

CPC .. F04D 17/16; F04D 29/22–281; F04D 29/30; F04D 29/663; F04D 29/666

See application file for complete search history.

(56) References Cited

U.S. PATENT DOCUMENTS 5,984,632 A * 11/1999 Lee ..... A47L 5/22 415/206
2012/0057966 A1 3/2012 Chen et al.
2013/0089425 A1 4/2013 Wu et al.
2015/0375294 A1* 12/2015 Vestermark Vad ..... F04D 29/2222 419/38
2019/0218737 A1 7/2019 Hansmann

FOREIGN PATENT DOCUMENTS

| | | | |
|---|---|---|---|
| CN | 102954035 | A | 3/2013 |
| CN | 202811503 | U | 3/2013 |
| CN | 202926707 | U | 5/2013 |

(Continued)

OTHER PUBLICATIONS

Translation of 2011080477 (Year: 2011).*

(Continued)

*Primary Examiner* — Eldon T Brockman
*Assistant Examiner* — Brian O Peters
(74) *Attorney, Agent, or Firm* — Bradley J. Thorson; DeWitt LLP

(57) ABSTRACT

A disk-shaped fan impeller structure includes a plate body having an inner rim and an outer rim. The inner rim is connected with a hub via multiple connection members. The outer rim extends in a direction away from the hub. The connection members are annularly disposed on outer circumference of the hub at intervals to radially extend toward the inner rim of the plate body. A top face and a bottom face are defined between the inner rim and outer rim. Multiple upper boss bodies are arranged on the top face at intervals. Multiple first gaps are distributed between the upper boss bodies. By means of the boss bodies, the periodical noise problem of the conventional fan impeller can be improved.

25 Claims, 22 Drawing Sheets

(56) References Cited

FOREIGN PATENT DOCUMENTS

| | | | | |
|---|---|---|---|---|
| CN | 203516181 | U | | 4/2014 |
| CN | 104454635 | A | | 3/2015 |
| CN | 207033833 | U | | 2/2018 |
| CN | 211666936 | U | | 10/2020 |
| JP | 2011080477 | | * | 2/2011 |
| TW | M553896 | U | | 1/2018 |
| TW | M592214 | U | | 3/2020 |

OTHER PUBLICATIONS

Search Report dated Jun. 3, 2020 issued by Taiwan Intellectual Property Office for counterpart application No. 108142986.
Search Report dated Sep. 11, 2020 issued by China National Intellectual Property Administration for counterpart application No. 2019111744978.
Search Report dated Apr. 18, 2021 issued by China National Intellectual Property Administration for counterpart application No. 2019111744978.
Search Report dated Aug. 12, 2021 issued by China National Intellectual Property Administration for counterpart application No. 2019111744978.

* cited by examiner

DISK-SHAPED FAN IMPELLER STRUCTURE

BACKGROUND OF THE INVENTION

1. Field of the Invention

The present invention relates generally to a cooling fan, and more particularly to a disk-shaped fan impeller structure.

2. Description of the Related Art

A conventional fan impeller dissipates heat in an active manner. The fan impeller mainly includes a hub and multiple blades arranged along the circumference of the hub at intervals to radially outward extend. A flow way is defined between each two blades. When the fan impeller rotates, the blades drive the fluid to flow. However, the blades are often non-uniformly arranged or the weights of the blades are uneven. Therefore, when the fan impeller rotates, the blades will cause airflow separation effect. In addition, when the blades periodically blow wind, the blades will create a pulse force to produce wind shear sound. Also, the flowing airflows will interfere with each other. All the above will cause periodical noise problem (blade pass frequency, BPF).

It is therefore tried by the applicant to provide a disk-shaped fan impeller structure to solve the above problem.

SUMMARY OF THE INVENTION

It is therefore a primary object of the present invention to provide a disk-shaped fan impeller structure, which can lower the periodical noise problem caused by the blades.

It is a further object of the present invention to provide the above disk-shaped fan impeller structure, in which the connection members can be selectively ribs or blades. In case of ribs, the disk-shaped fan impeller structure is free from any blade. In case of blades, the connection members and the plate body form a complex disk-shaped fan impeller structure.

It is still a further object of the present invention to provide the above disk-shaped fan impeller structure, in which the connection members can be selectively ribs so that no matter the fan impeller is clockwise rotated or counterclockwise rotated, the disk-shaped fan impeller structure can drive the airflow to flow.

To achieve the above and other objects, the disk-shaped fan impeller structure of the present invention includes a plate body having an inner rim and an outer rim. The inner rim is connected with a hub via multiple connection members. The outer rim extends in a direction away from the hub. The connection members are annularly disposed on outer circumference of the hub at intervals to radially extend toward the inner rim of the plate body. A top face and a bottom face are defined between the inner rim and outer rim. Multiple upper boss bodies are arranged on the top face at intervals. Multiple first gaps are distributed between the upper boss bodies.

Still to achieve the above and other objects, the disk-shaped fan impeller structure of the present invention includes: a hub having a top wall and a circumferential wall perpendicularly extending from an outer circumference of the top wall, the top wall corresponding to a wind inlet of a frame body; a plate body having an inner rim and an outer rim, the inner rim surrounding and facing the circumferential wall of the hub, the outer rim radially extending in a direction away from the hub, the inner rim being connected with the circumferential wall of the hub, a top face and a bottom face being defined between the inner rim and the outer rim, multiple upper boss bodies being arranged on the top face between the inner rim and the outer rim at intervals, a first gap being defined around each upper boss body; and multiple connection members disposed between the circumferential wall of the hub and the inner rim of the plate body, the connection members being arranged at intervals in a radial form to radially extend, each connection member having an inner end and an outer end, the inner end being connected with the circumferential wall of the hub, the outer end being connected with the inner rim of the plate body.

Still to achieve the above and other objects, the disk-shaped fan impeller structure of the present invention is disposed in a fan frame. The fan frame has a wind inlet and a wind outlet. The disk-shaped fan impeller structure includes: a hub corresponding to the wind inlet of a frame body, the hub having multiple connection members, the connection members extending in a direction away from the hub to form an outer end; and a plate body surrounding the connection members and connected with the outer ends of the connection members, multiple upper boss bodies and multiple first gaps being arranged on one face of the plate body, the first gaps being distributed around the upper boss bodies to space the adjacent upper boss bodies, an airflow flowing from the wind inlet into the fan frame to flow through the connection members and the plate body and then flow out of the fan frame from the wind outlet.

In the above disk-shaped fan impeller structure, the upper boss bodies are arranged and distributed at equal intervals and/or unequal intervals.

In the above disk-shaped fan impeller structure, the upper boss bodies and the plate body are integrally formed.

In the above disk-shaped fan impeller structure, the upper boss bodies and the plate body are separate unit bodies connected with each other by a connection means.

In the above disk-shaped fan impeller structure, each upper boss body has a first axial height. The first axial heights of the respective upper boss bodies are equal to or unequal to each other.

In the above disk-shaped fan impeller structure, the first axial heights of the upper boss bodies are gradually increased or decreased from the inner rim to the outer rim.

In the above disk-shaped fan impeller structure, the first axial heights of the upper boss bodies are gradually increased and then decreased from the inner rim to the outer rim or gradually decreased and then increased from the inner rim to the outer rim.

In the above disk-shaped fan impeller structure, the plate body is one single annular plate body and the plate body. The hub and the connection members are integrally formed or not integrally formed.

In the above disk-shaped fan impeller structure, the plate body includes multiple subsidiary plate body sections, which are assembled to together form an annular plate body.

In the above disk-shaped fan impeller structure, each upper boss body has a cross-sectional form in parallel to the plate body. The cross-sectional form of the upper boss body is a geometrical shape selected from a group consisting of circular shape, quadrilateral shape, triangular shape, elliptic shape, pentagonal shape, hexagonal shape, arched shape, windmill shape and pentagram shape.

In the above disk-shaped fan impeller structure, the upper boss bodies are arranged and distributed in identical pattern or different patterns.

In the above disk-shaped fan impeller structure, the upper boss bodies are arranged and distributed from the inner rim to the outer rim in a radial form or as multiple concentric circles.

In the above disk-shaped fan impeller structure, the upper boss bodies are arranged and distributed from the inner rim to the outer rim in multiple geometrical forms.

In the above disk-shaped fan impeller structure, each upper boss body has a first outer diameter. The first outer diameters of the respective upper boss bodies are equal to or unequal to each other.

In the above disk-shaped fan impeller structure, the first outer diameters of the upper boss bodies are gradually increased or decreased from the inner rim to the outer rim.

In the above disk-shaped fan impeller structure, multiple lower boss bodies are arranged under the bottom face of the plate body at intervals.

Multiple second gaps are distributed between the lower boss bodies. The bottom face is a plane face or an inclined face.

In the above disk-shaped fan impeller structure, the upper boss bodies and the lower boss bodies are arranged in identical pattern or different patterns.

In the above disk-shaped fan impeller structure, the inner rim forms a wind inlet side and the outer rim forms a wind outlet side. The connection members are ribs or blades. The top face of the plate body is a plane face or an inclined face.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
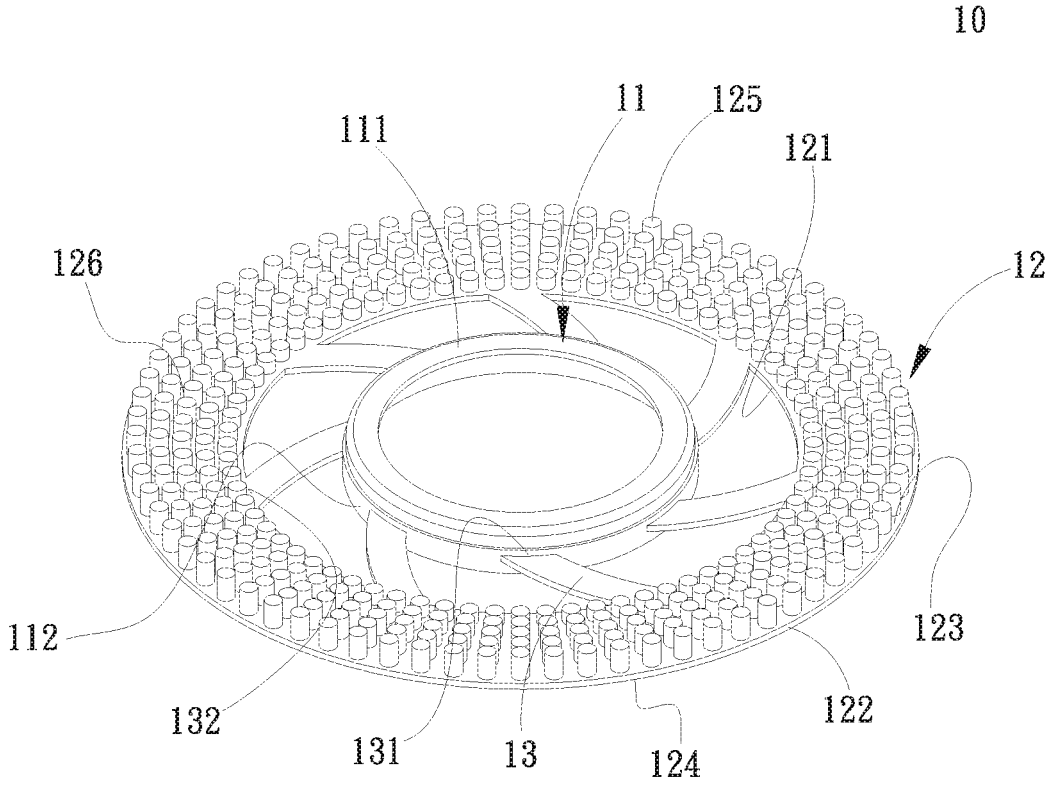
FIG. 1A is a perspective view of the present invention.
Figure 1B:
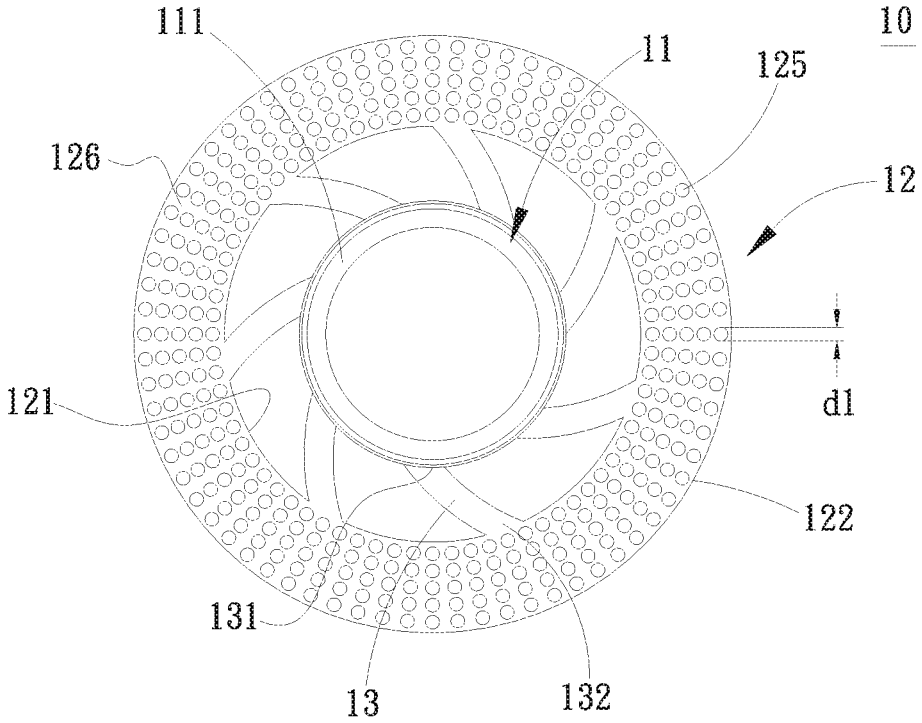
FIG. 1B is a top view of the present invention.

Please refer to FIGS. 1A and 1B. FIG. 1A is a perspective view of the present invention. FIG. 1B is a top view of the present invention. As shown in the drawings, the disk-shaped fan impeller structure 10 of the present invention includes a hub 11 and a plate body 12. The hub 11 has a top wall 111 and a circumferential wall 112 perpendicularly extending from an outer circumference of the top wall 111. In this embodiment, the top wall 111 is, but not limited to, formed with a perforation. Alternatively, the top wall 111 can be a structure without any perforation. The plate body 12 is such as an annular plate body annularly disposed around the hub 11. The plate body 12 has an inner rim 121 and an outer rim 122. The inner rim 121 surrounds and faces the circumferential wall 112 of the hub 11 to form a wind inlet side. The outer rim 122 radially extends in a direction away from the hub 11 to form a wind outlet side. A top face 123 and a bottom face 124 are defined between the inner rim 121 and the outer rim 122 respectively on upper face and lower face of the plate body 12. Multiple upper boss bodies 125 are arranged on the top face 123 at intervals. Multiple first gaps 126 are distributed between the upper boss bodies 125 and/or around the upper boss bodies 125.

Multiple connection members 13 are radially annularly disposed between the hub 11 and the plate body 12 at intervals. Each connection member 13 has an inner end 131 and an outer end 132. The inner end 131 is connected with the circumferential wall 112 of the hub 11. The outer end 132 is connected with the inner rim 121 of the plate body 12. In a preferred embodiment, the connection members 13, the hub 11 and the plate body 12 are integrally formed by means of such as plastic injection or 3D printing. Alternatively, the connection members 13, the hub 11 and the plate body 12 are not integrally formed and are connected with each other by means of such as welding, ultrasonic fusion, insertion or adhesion. Moreover, the materials of the hub 11, the plate body 12 and the connection members 13 can be the same or different. In case of different materials, the hub 11 and the plate body 12 can be made of plastic material, while the connection members 13 can be made of metal material. Alternatively, the plate body 12 and the connection members 13 are made of metal material, while the hub 11 is made of plastic material. Still alternatively, the hub 11, the plate body 12 and the connection members 13 can be made of different metal materials.

Figure 2A:
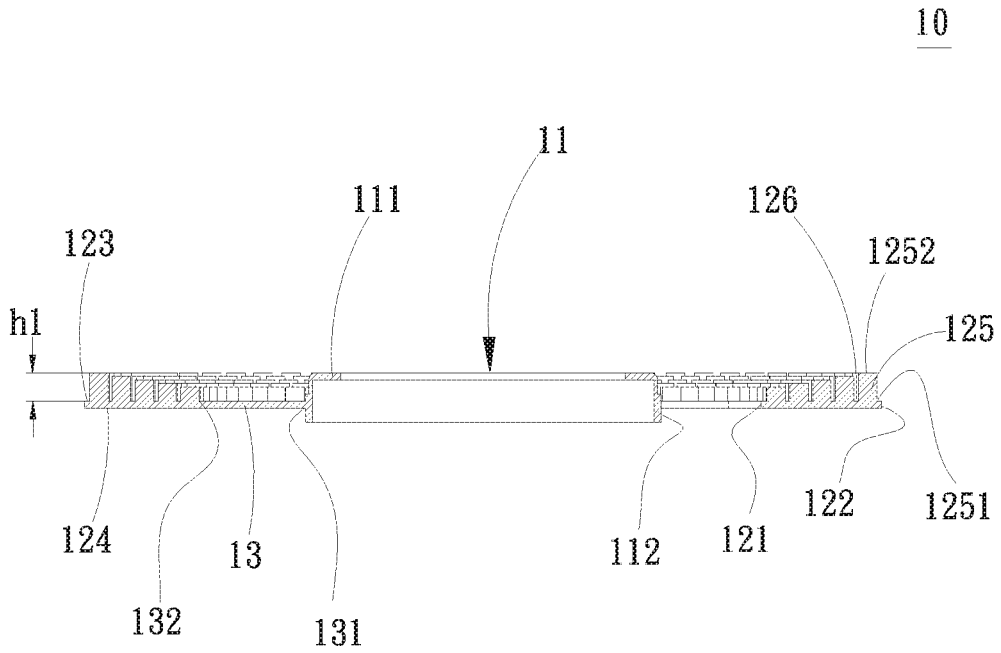
FIGS. 2A to 2F are sectional views of the present invention, showing that the first axial heights of the upper boss bodies are equal to or unequal to each other.
Figure 2B:
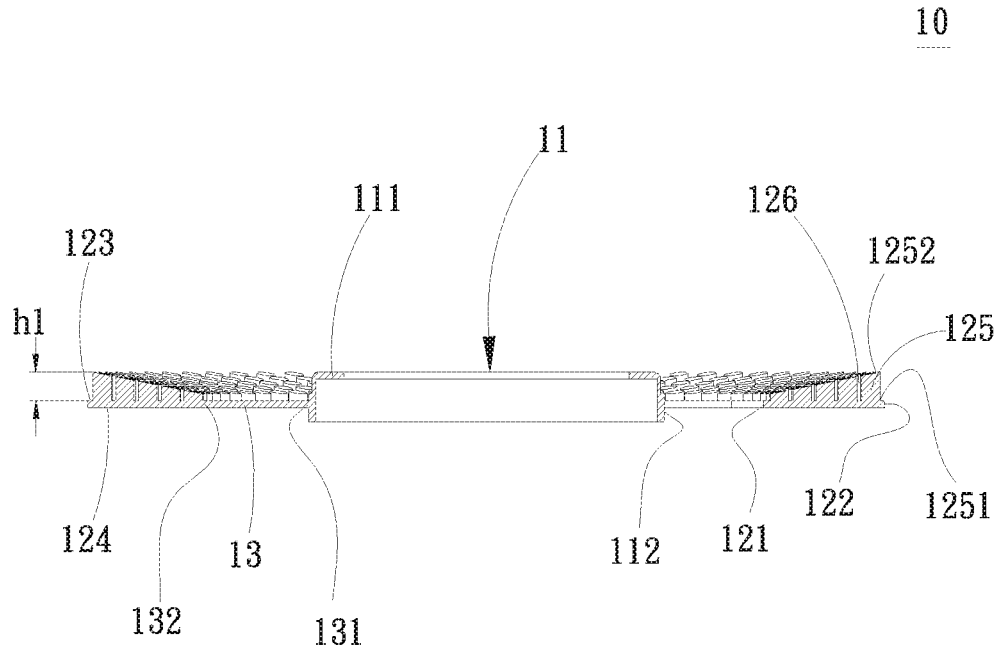
Figure 2C:
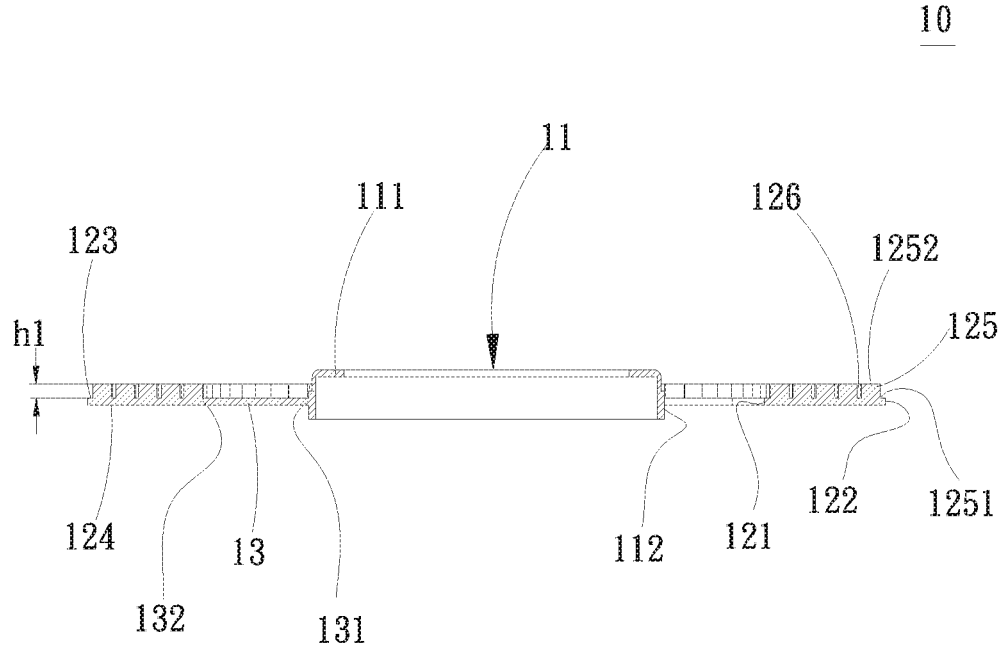
Figure 2D:
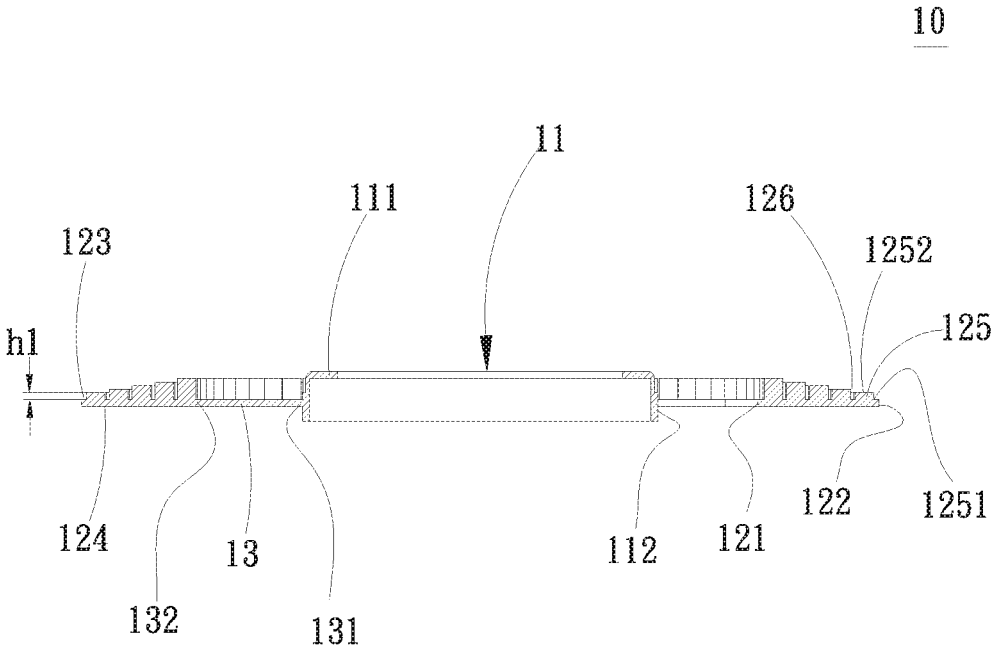
Figure 2E:
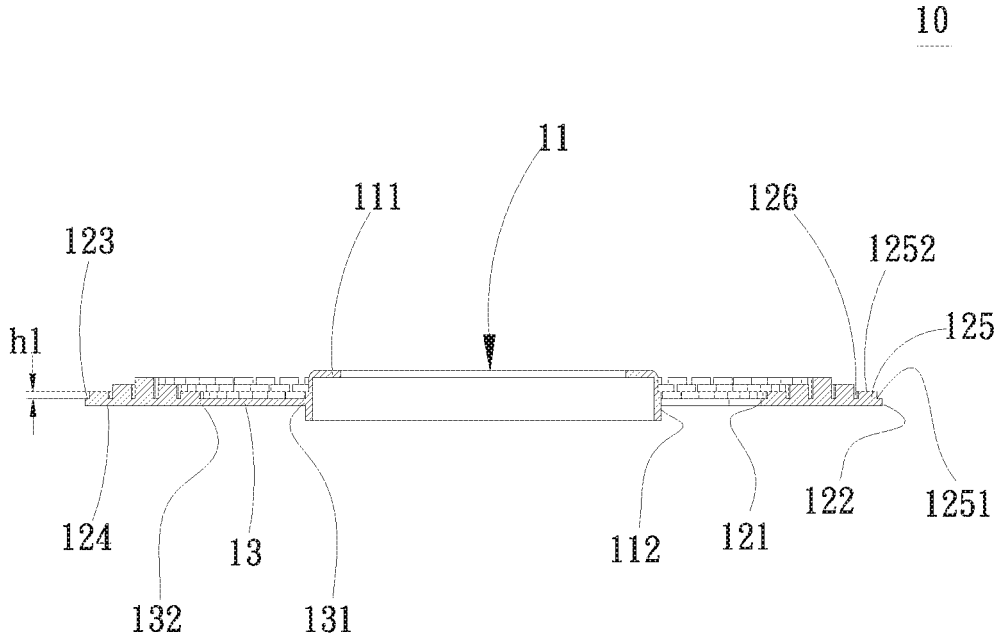
Figure 2F:
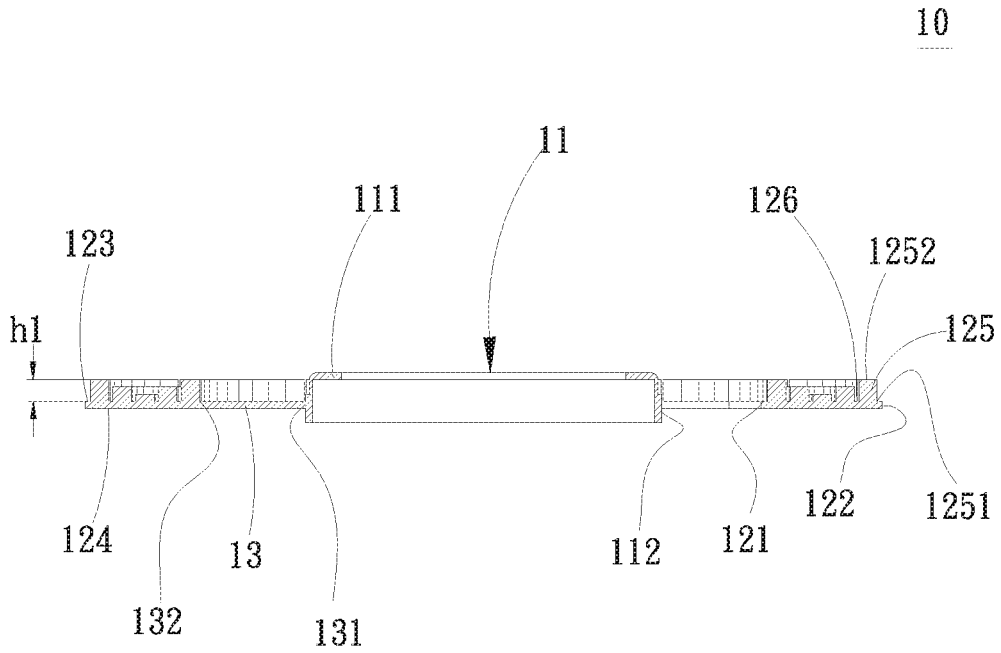

Please further refer to FIGS. 2A to 2F, which are sectional views of the present invention, showing that the first axial heights of the upper boss bodies are equal to or unequal to each other. As shown in the drawings, each upper boss body 125 has a first bottom end 1251 and a first free end 1252. The first bottom end 1251 is connected with the top face 123 of the plate body 12. The first free end 1252 upward extends. A first axial height h1 is defined between the first bottom end 1251 and the first free end 1252. The first axial height h1 can be varied to have different aspects according to the use requirement or in adaptation to the form of the fan frame. For example, in a preferred embodiment as shown in FIGS. 2A and 2B, the first axial heights h1 of the upper boss bodies 125 are gradually increased from the inner rim 121 to the outer rim 122 and the first free ends 1252 of the upper boss bodies 125 are horizontal (as shown in FIG. 2A) or inclined (as shown in FIG. 2B). In FIG. 2B, the first free ends 1252 are, but not limited to, inclined toward the hub 11. Alternatively, the first free ends 1252 can be inclined in a direction away from the hub 11. In this embodiment, the first axial height h1 of the upper boss body 125 near the inner rim 121 is lower than the first axial height h1 of the upper boss body 125 near the outer rim 122. In another embodiment, the first axial heights h1 of all the upper boss bodies 125 are identical to each other (as shown in FIG. 2C). In a modified embodiment, the first axial heights h1 of the upper boss bodies 125 are gradually decreased from the inner rim 121 to the outer rim 122. That is, the first axial height h1 of the upper boss body 125 near the inner rim 121 is higher than the first axial height h1 of the upper boss body 125 near the outer rim 122 (as shown in FIG. 2D). Alternatively, the first axial heights h1 of the upper boss bodies 125 are gradually increased and then gradually decreased. That is, the first axial heights h1 of the upper boss bodies 125 near the inner rim 121 and the outer rim 122 are higher than the first axial height h1 of the upper boss body 125 in the middle (as shown in FIG. 2E). Alternatively, the first axial heights h1 of the upper boss bodies 125 are gradually decreased and then gradually increased. That is, the first axial heights h1 of the upper boss bodies 125 near the inner rim 121 and the outer rim 122 are lower than the first axial height h1 of the upper boss body 125 in the middle (as shown in FIG. 2F). Notably, in the embodiments of FIGS. 2A, 2B, 2G and 211, the first free ends 1252 of at least some of upper boss bodies 125 are substantially co-planar with top wall 111 of hub 11.

Figure 2G:
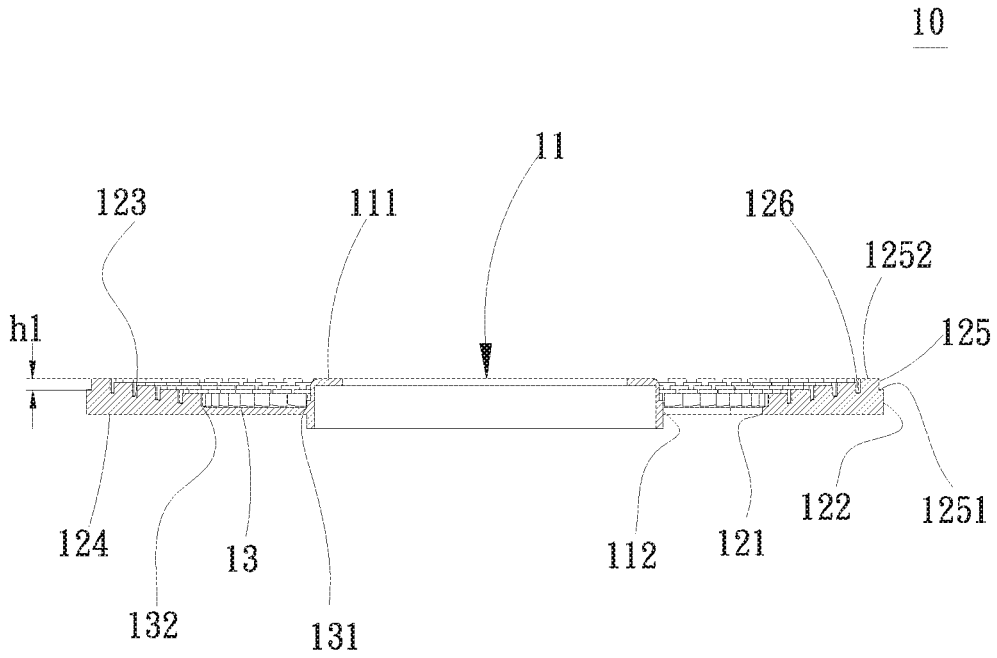
FIGS. 2G and 2H are sectional views of the present invention, showing other different aspects of the top face of the plate body.
Figure 2H:
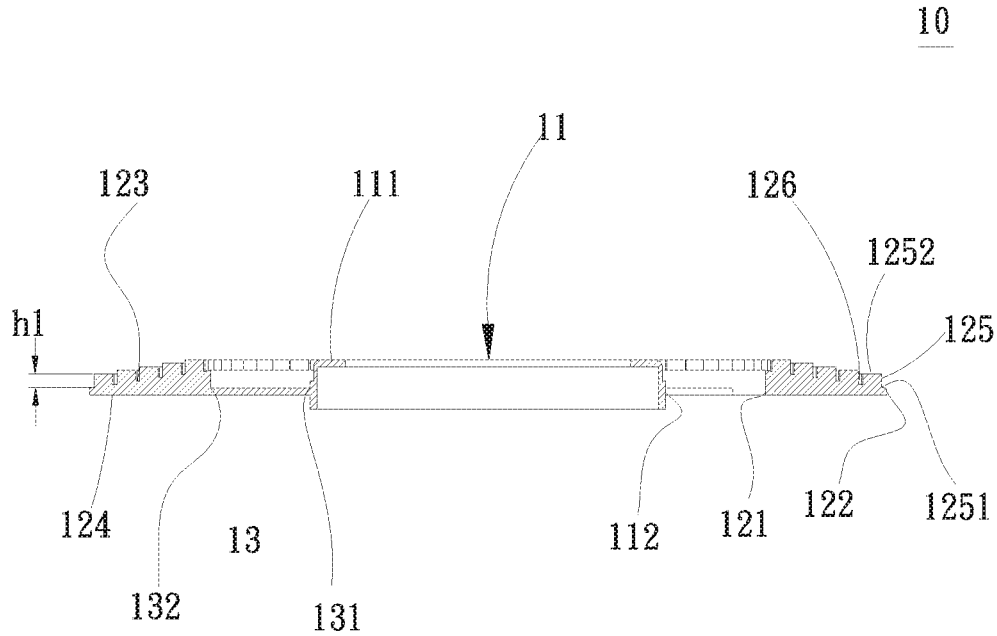

Moreover, please further refer to FIGS. 2G and 2H. In the above embodiments, the top face 123 of the plate body 12 is, but not limited to, a plane face. In some modified embodiments, the top face 123 of the plate body 12 can be an inclined face. For example, the top face 123 of the plate body 12 is inclined toward the hub (as shown in FIG. 2G) or inclined in a direction away from the hub (as shown in FIG. 2H). In this embodiment, the upper boss bodies 125 are gradually raised from the inner rim 121 to the outer rim 122 (as shown in FIG. 2G) or gradually lowered from the inner rim 121 to the outer rim 122 (as shown in FIG. 2F). It should be noted that in the drawings, the upper boss bodies 125 have the same first axial height h1. However, this is not limited. This arrangement is also applicable to those embodiments in which the upper boss bodies 125 have different first axial heights h1.

Please further refer to FIGS. 3A to 3F, which are top views of the present invention, showing that the upper boss bodies are arranged and distributed in the same pattern or different patterns. Also referring to FIG. 1B, the upper boss bodies 125 are, but not limited to, arranged and distributed from the inner rim 121 to the outer rim 122 as multiple concentric circles.

Figure 3A:
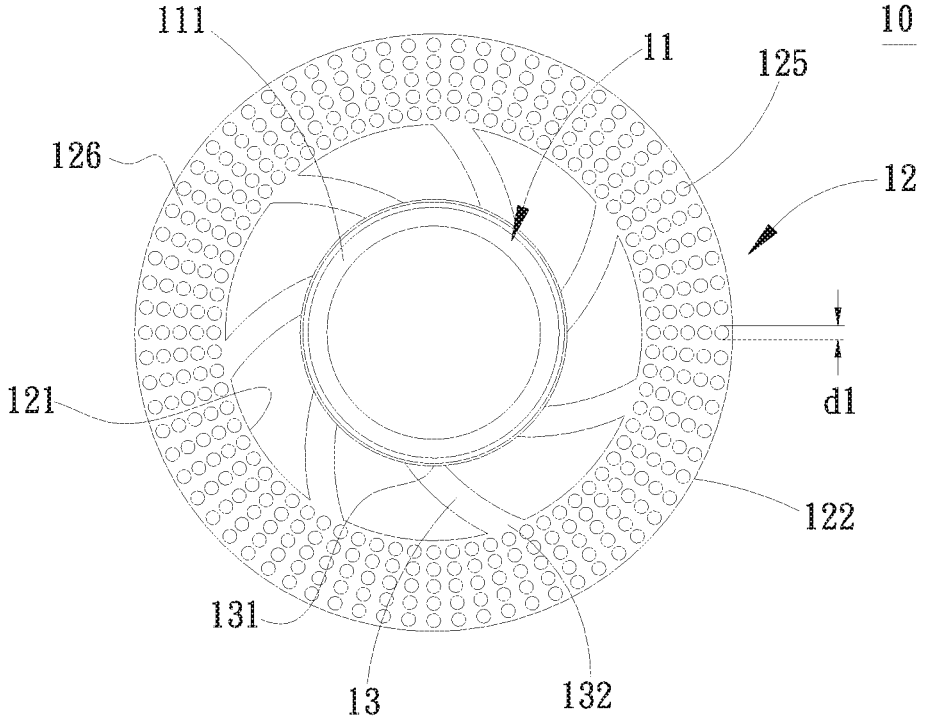
FIGS. 3A to 3F are top views of the present invention, showing that the upper boss bodies are arranged and distributed in the same pattern or different patterns.
Figure 3B:
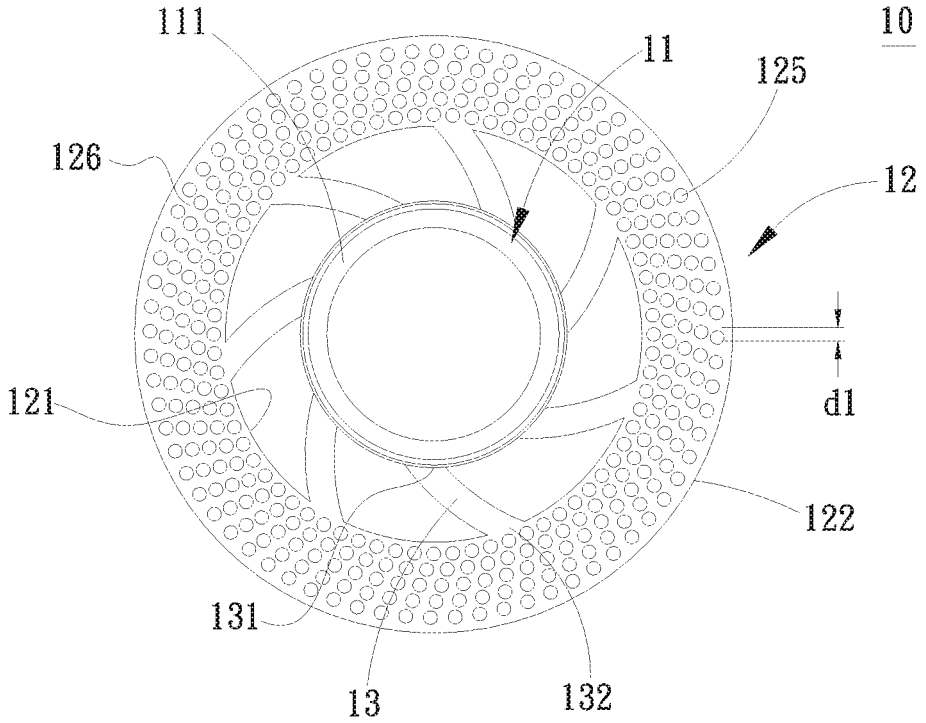
Figure 3C:
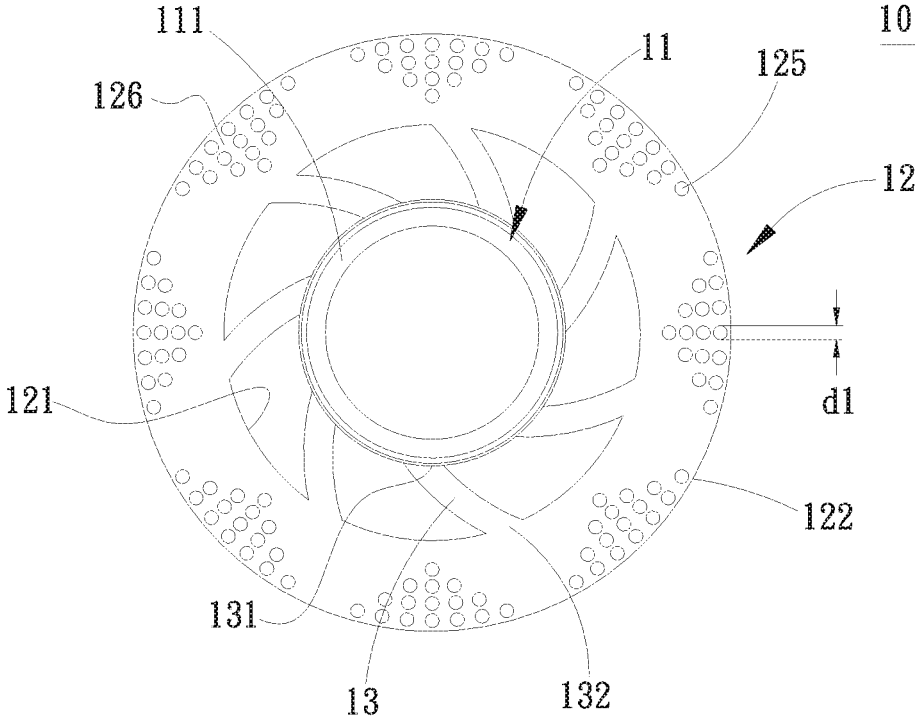
Figure 3D:
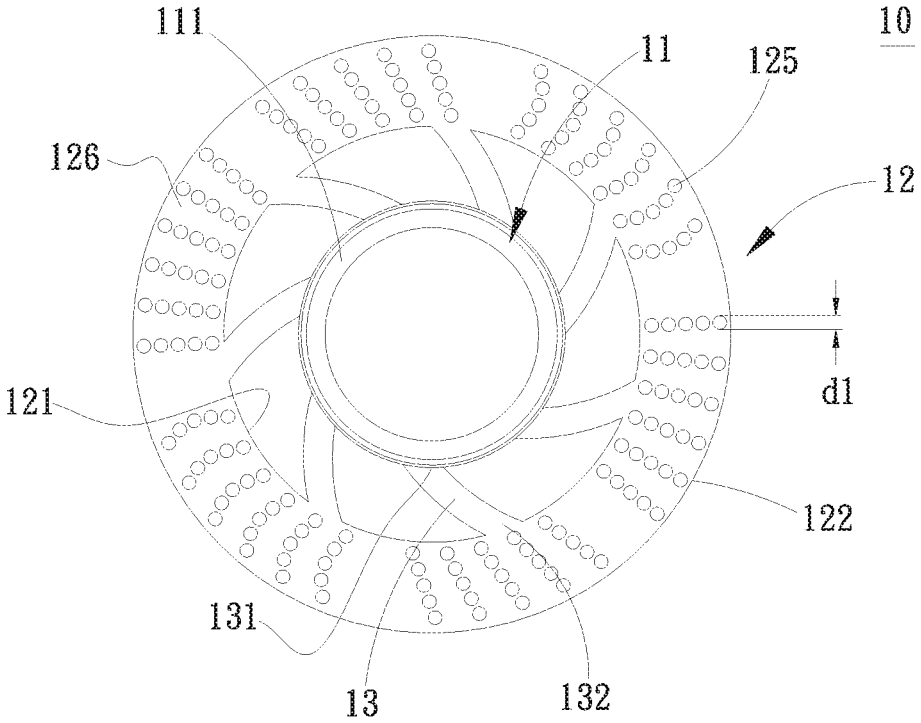
Figure 3E:
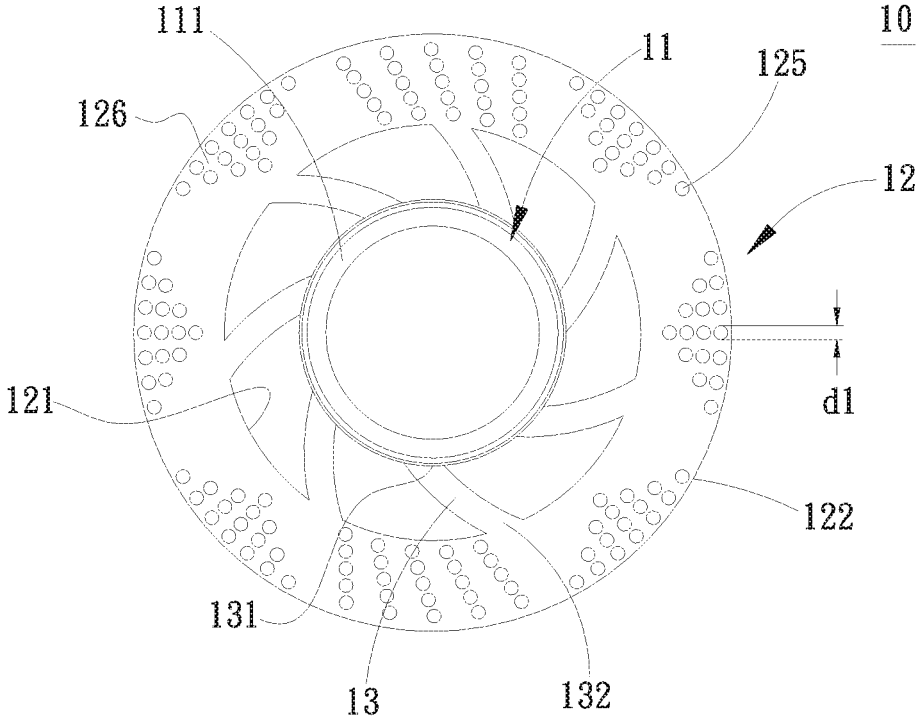

In some other embodiments, the upper boss bodies 125 are arranged and distributed from the inner rim 121 to the outer rim 122 in a radial form (as shown in FIGS. 3A and 3B). In FIG. 3A, the upper boss bodies 125 are arranged and distributed in a straight radial form. In FIG. 3B, the upper boss bodies 125 are arranged and distributed in a bent radial form. Alternatively, the upper boss bodies 125 can be arranged and distributed in different geometrical forms. For example but not limited, the upper boss bodies 125 can be arranged and distributed in multiple triangular forms (as shown in FIG. 3C). In some other embodiments as shown in FIGS. 3D and 3E, the top face of the plate body is divided into several sections.

Figure 3F:
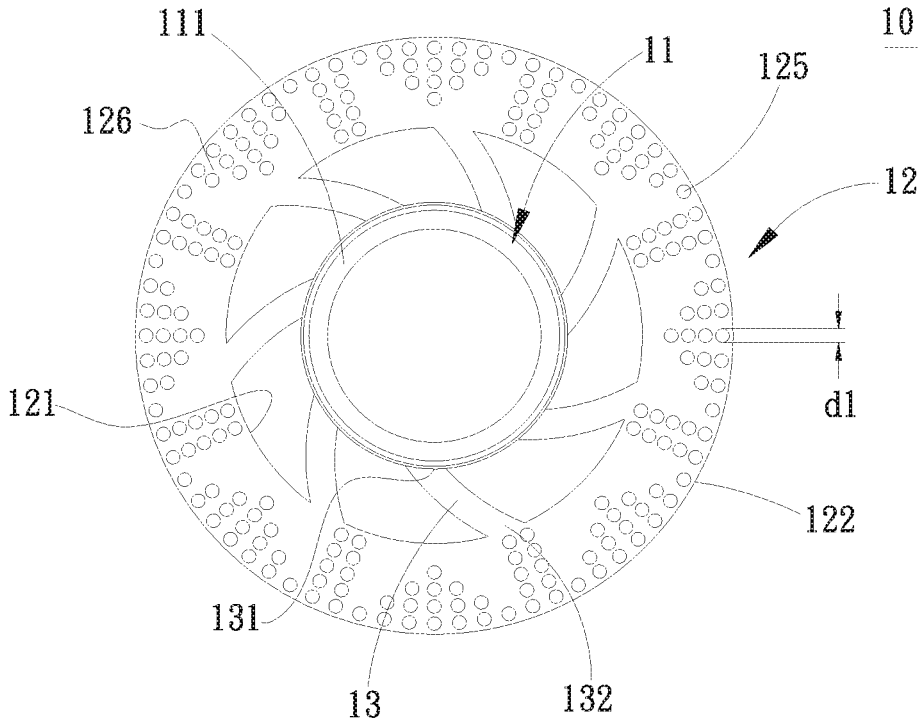

The upper boss bodies 125 of the respective sections are arranged and distributed in different patterns or manners. For example, the upper boss bodies 125 in some sections are arranged and distributed in a straight radial form, while the upper boss bodies 125 on the rest sections are arranged and distributed in a bent radial form (as shown in FIG. 3D). Alternatively, the upper boss bodies 125 in some sections are arranged in a triangular form, while the upper boss bodies 125 on the rest sections are arranged in a bent radial form (as shown in FIG. 3E). Still alternatively, the upper boss bodies 125 in some sections are arranged in a triangular form, while the upper boss bodies 125 on the rest sections are arranged in a straight radial form (as shown in FIG. 3F). Moreover, in the above embodiments, the upper boss bodies 125 can be arranged at equal intervals (as shown in FIGS. 1B, 3A and 3B) and/or at unequal intervals (as shown in FIGS. 3C, 3E and 3F). Therefore, the density of the first gaps 126 can be adjusted and set according to the requirement. For example, the larger the intervals between the upper boss bodies 125 are, the smaller the density of the first gaps 126 is and the smaller the intervals between the upper boss bodies 125 are, the larger the density of the first gaps 126 is.

Figure 4A:
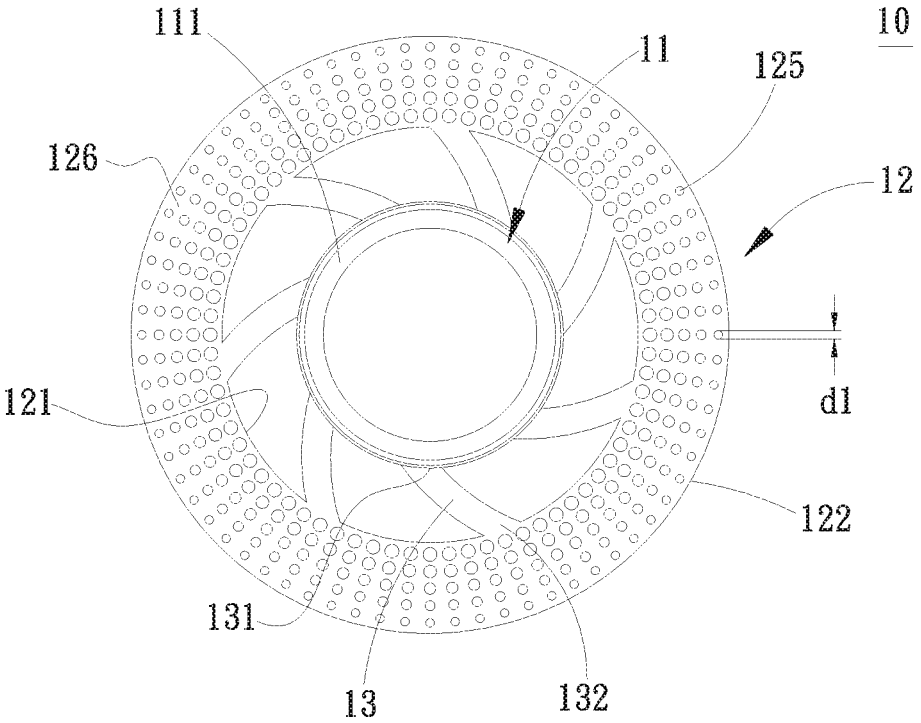
FIGS. 4A and 4B are top views of the present invention, showing that the upper boss bodies have different first outer diameters.
Figure 4B:
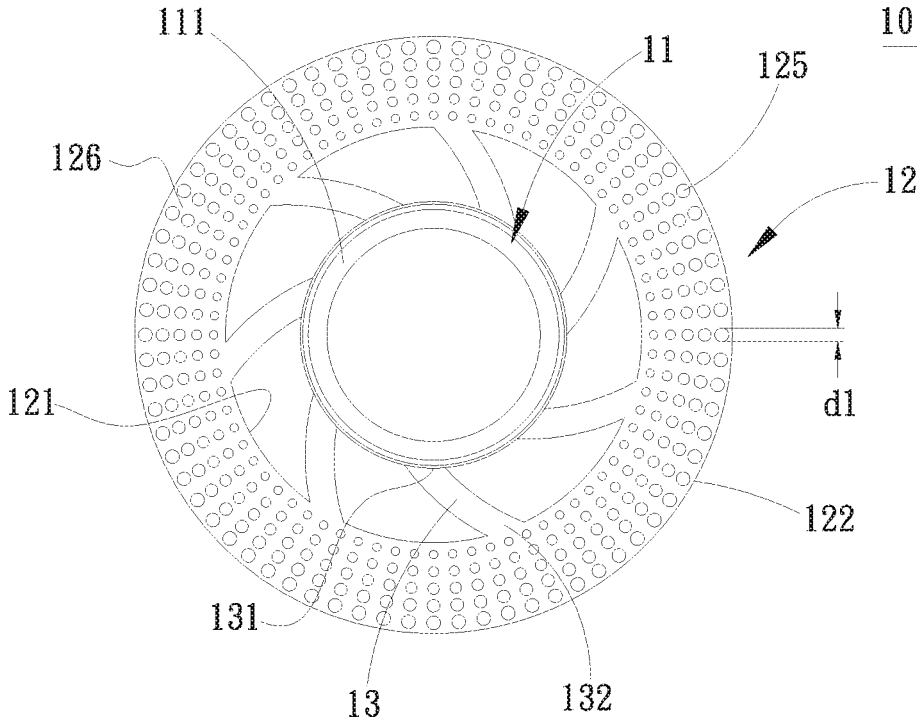

Please further refer to FIGS. 4A and 4B, which are top views of the present invention, showing that the upper boss bodies have different first outer diameters. Also refer to FIG. 1B, each upper boss body 125 has a first outer diameter d1. The first outer diameter d1 is defined as the straight distance between two opposite outermost tangential points. In this drawing, the first outer diameters d1 of the upper boss bodies 125 are, but not limited to, equal to each other. In a modified embodiment as shown in FIG. 4A, the first outer diameters d1 of the upper boss bodies 125 are gradually increased from the inner rim 121 of the plate body 12 to the outer rim 122. That is, the first outer diameter d1 of the upper boss body 125 near the outer rim 122 is larger than the first outer diameter d1 of the upper boss body 125 near the inner rim 121. Alternatively, as shown in FIG. 4B, the first outer diameters d1 of the upper boss bodies 125 are gradually decreased from the inner rim 121 of the plate body 12 to the outer rim 122. That is, the first outer diameter d1 of the upper boss body 125 near the inner rim 121 is larger than the first outer diameter d1 of the upper boss body 125 near the outer rim 122.

Figure 5A:
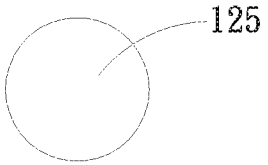
FIGS. 5A to 5I are top views showing the cross sections of the upper boss bodies of the present invention.
Figure 5B:
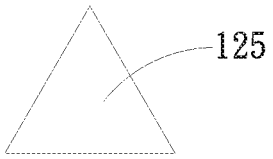
Figure 5C:
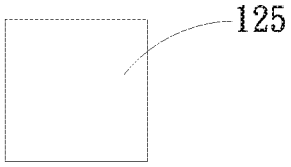
Figure 5D:
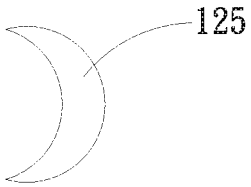
Figure 5E:
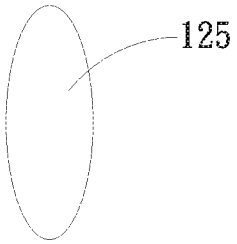
Figure 5F:
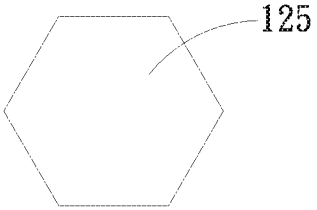
Figure 5G:
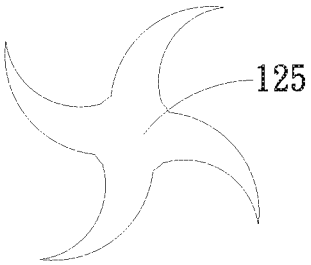
Figure 5H:
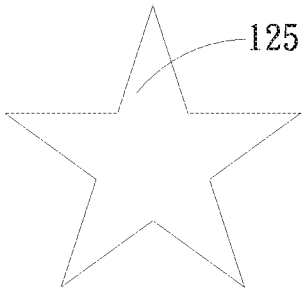
Figure 5I:
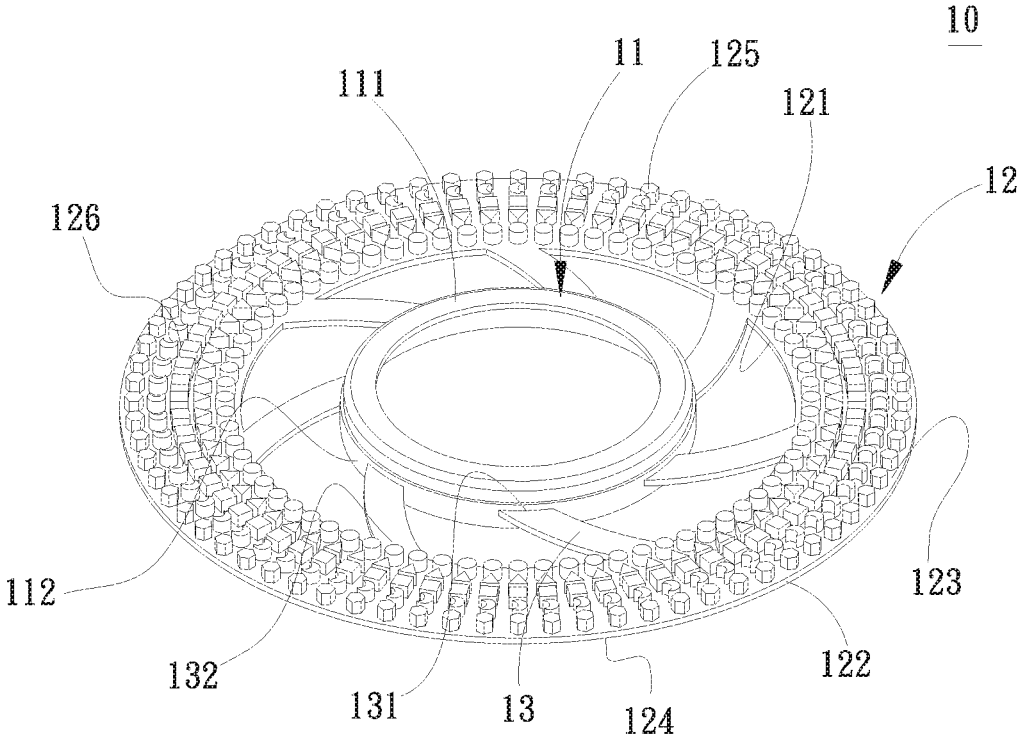

Please further refer to FIGS. 5A to 5I, which are top views showing the cross sections of the upper boss bodies of the present invention. As shown in the drawings, each upper boss body 125 has a cross-sectional form in parallel to the plate body 12 (as shown in FIG. 1A). The cross-sectional form can be any geometrical shape. In the above embodiments, the cross-sectional form is circular shape (as shown in FIG. 5A) so that each upper boss body 125 has, but not limited to, a cylindrical configuration. In some other embodiments, the cross-sectional form can be such as triangular shape (as shown in FIG. 5B), quadrilateral shape (as shown in FIG. 5C), crescent shape (as shown in FIG. 5D, elliptic shape (as shown in FIG. 5E), hexagonal shape (as shown in FIG. 5F), windmill shape (as shown in FIG. 5G) and pentagram shape (as shown in FIG. 5H). In addition, as shown in FIG. 5I, in a modified embodiment, the upper boss bodies 125 on the top face 123 of the plate body 12 have different cross-sectional shapes. For example but not limited, some of the upper boss bodies 125 have circular shape, some have triangular shape, some have quadrilateral shape, some have crescent shape and the rests have pentagram shape.

Figure 6A:
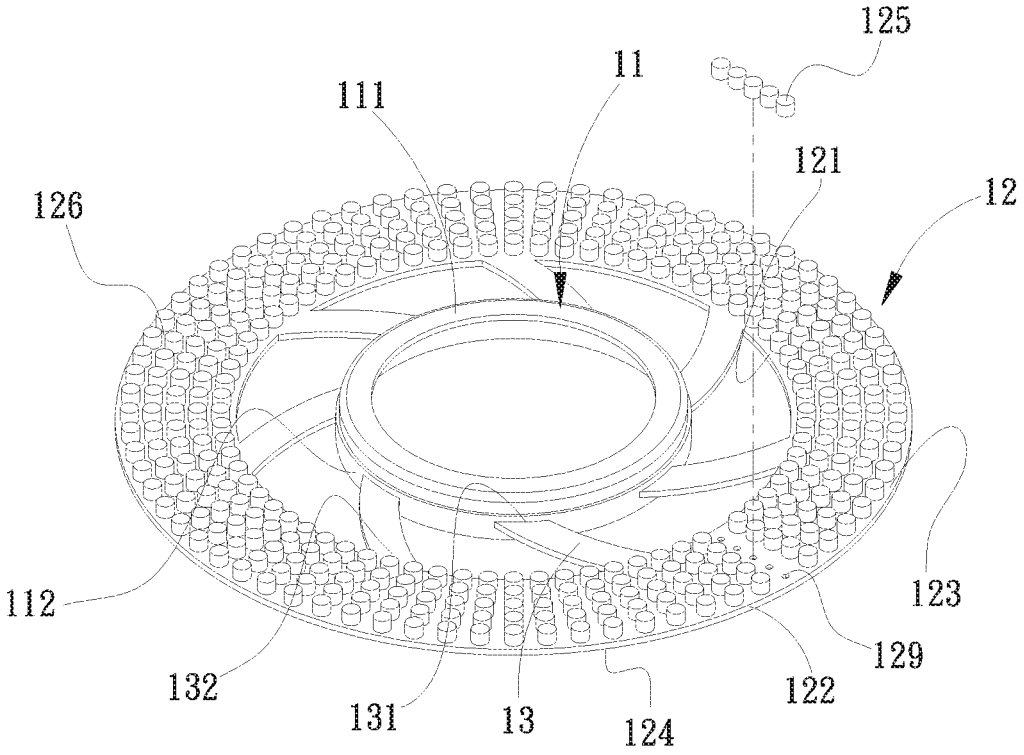
FIGS. 6A and 6B show that the upper boss bodies and the plate body of the present invention are separate unit bodies.
Figure 6B:
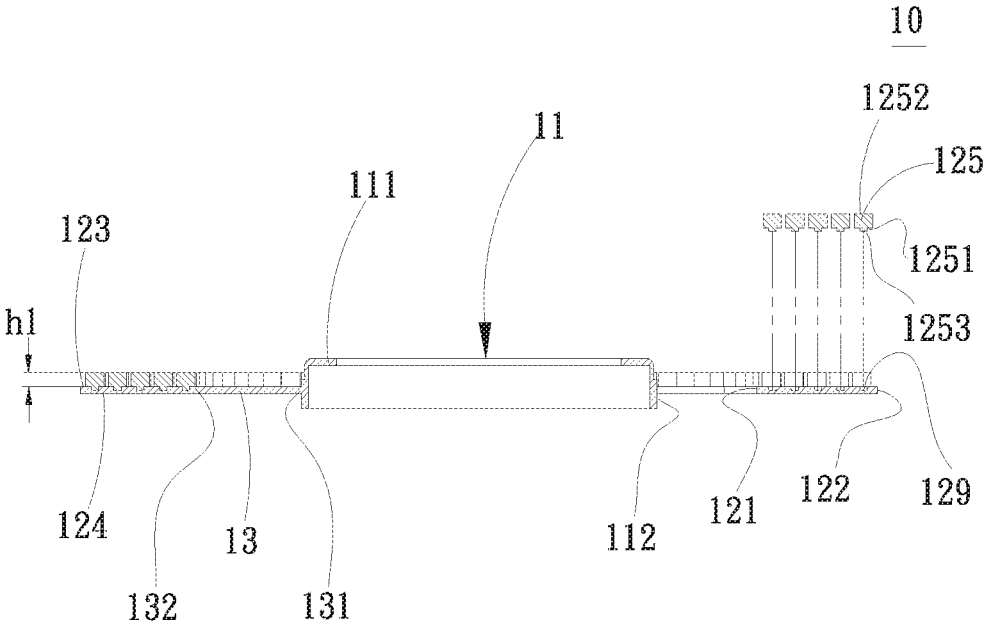

Please further refer to FIGS. 6A and 6B, which show that the upper boss bodies and the plate body of the present invention are separate unit bodies. Also referring to FIGS. 1A and 2A, the upper boss bodies 125 and the plate body 12 are integrally formed by means of such as plastic injection or 3D printing. That is, the upper boss bodies 125 are directly formed on the top face 123 of the plate body 12. However, in some other embodiments as shown in FIGS. 6A and 6B, the upper boss bodies 125 and the plate body 12 are separate unit bodies connected with each other by a connection means. In this drawing, the top face 123 of the plate body 12 is formed with multiple sockets 129 arranged at intervals. Each upper boss body 125 has an insertion section 1253 correspondingly inserted in the socket 127. In some other embodiments, the upper boss bodies 125 are connected on the top face 123 of the plate body 12 by means of such as adhesion or welding.

Figure 7A:
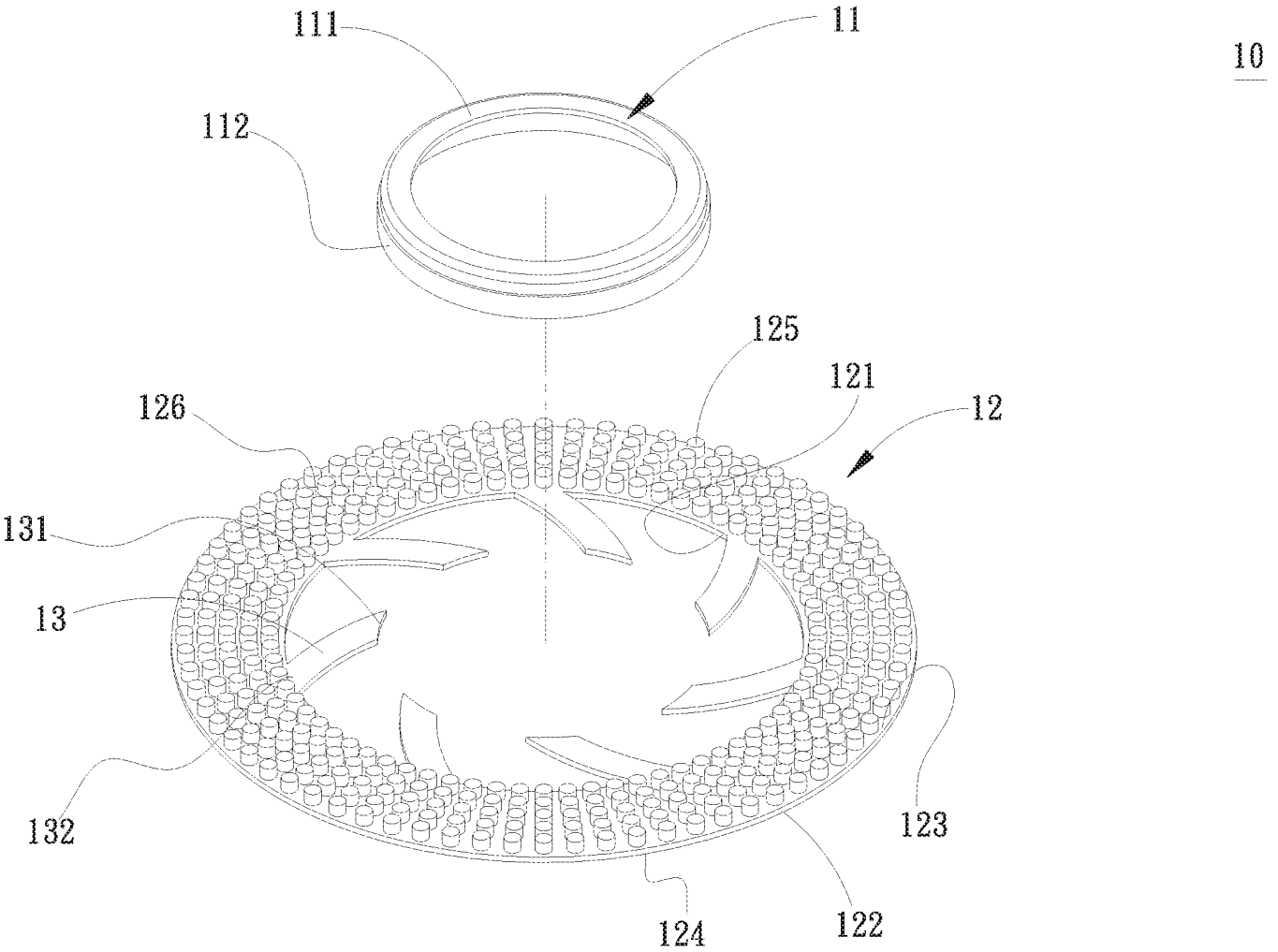
FIGS. 7A to 7D show some other embodiments of the connection between the plate body and the hub of the present invention.
Figure 7B:
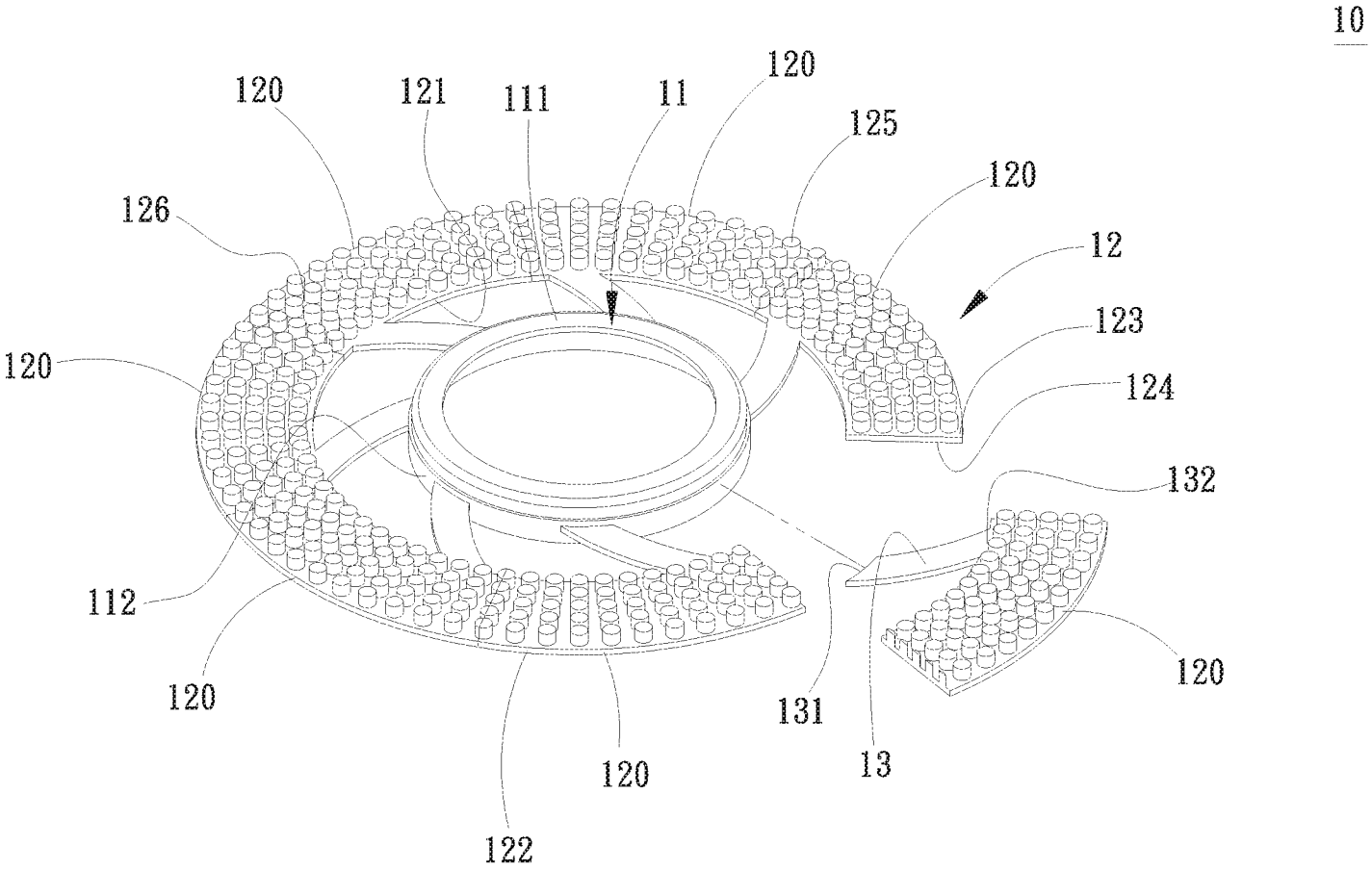

Please further refer to FIGS. 7A to 7D, which show some other embodiments of the connection between the plate body and the hub of the present invention. Also referring to FIGS. 1A and 1B, the plate body 12, the hub 11 and the connection members 13 are, but not limited to, integrally formed. In a modified embodiment as shown in FIG. 7A, the plate body 12 and the hub 11 are not an integrally formed structure, but are separate unit bodies. The connection members 13 and the plate body 12 are integrally formed. The outer ends 132 of the connection members 13 are integrally connected with the inner rim 121 of the plate body 12. The inner ends 131 radially extend toward the hub 11 to connect with the circumferential wall 112. In another embodiment as shown in FIG. 7B, the plate body 12 includes multiple subsidiary plate body sections 120. (In this drawing, there are, but not limited to, seven subsidiary plate body sections 120). The subsidiary plate body sections 120 are assembled to together form an annular plate body. Each subsidiary plate body section 120 is connected with the circumferential wall 112 of the hub 11 via at least one connection member 13. In addition, the arrangements of the upper boss bodies 125 on the respective subsidiary plate body sections 120 can be identical or different. For example, the gaps, the outer diameters, the arrangement patterns, the cross-sectional shapes or the first axial heights of the upper boss bodies 125 can be identical or different.

Figure 7C:
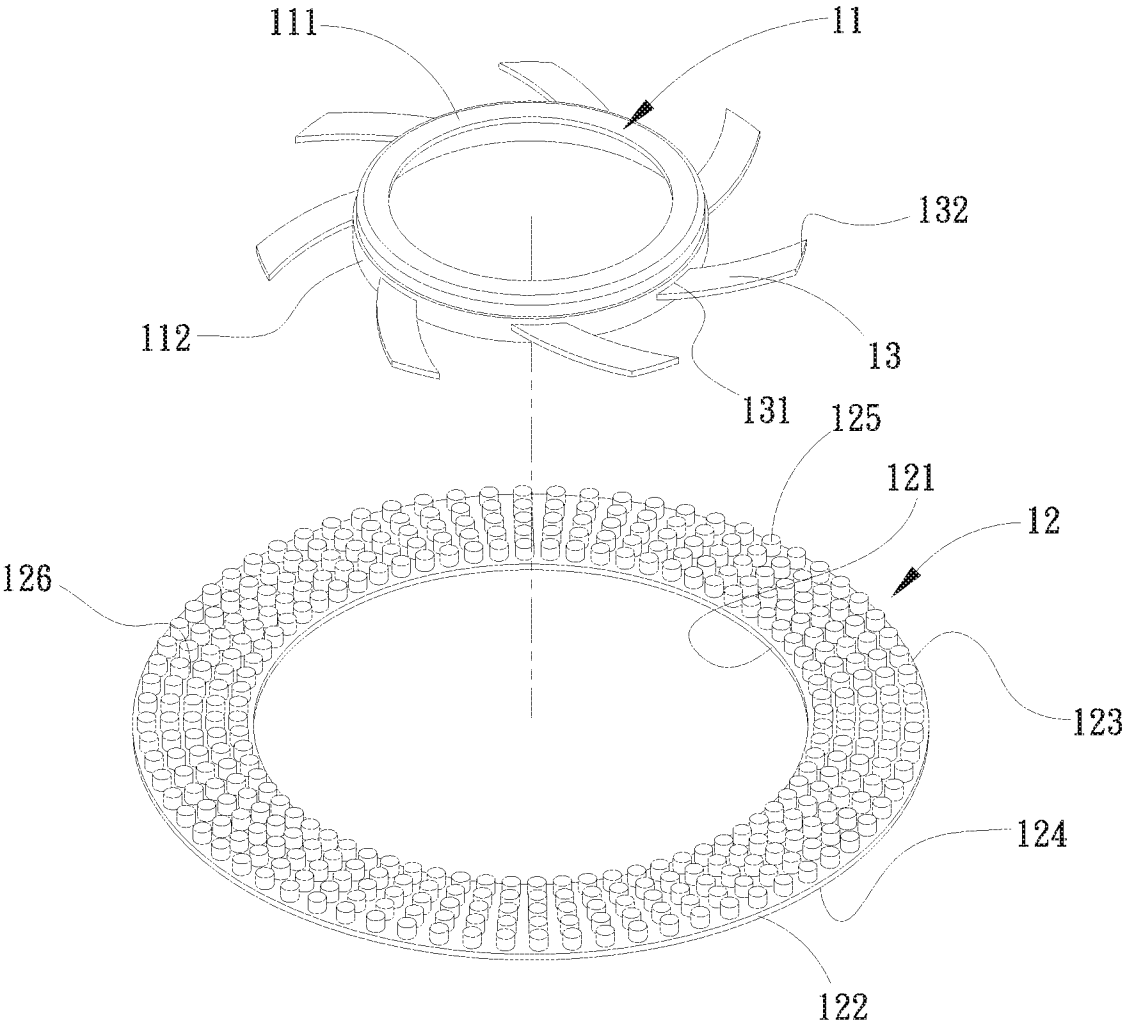
Figure 7D:
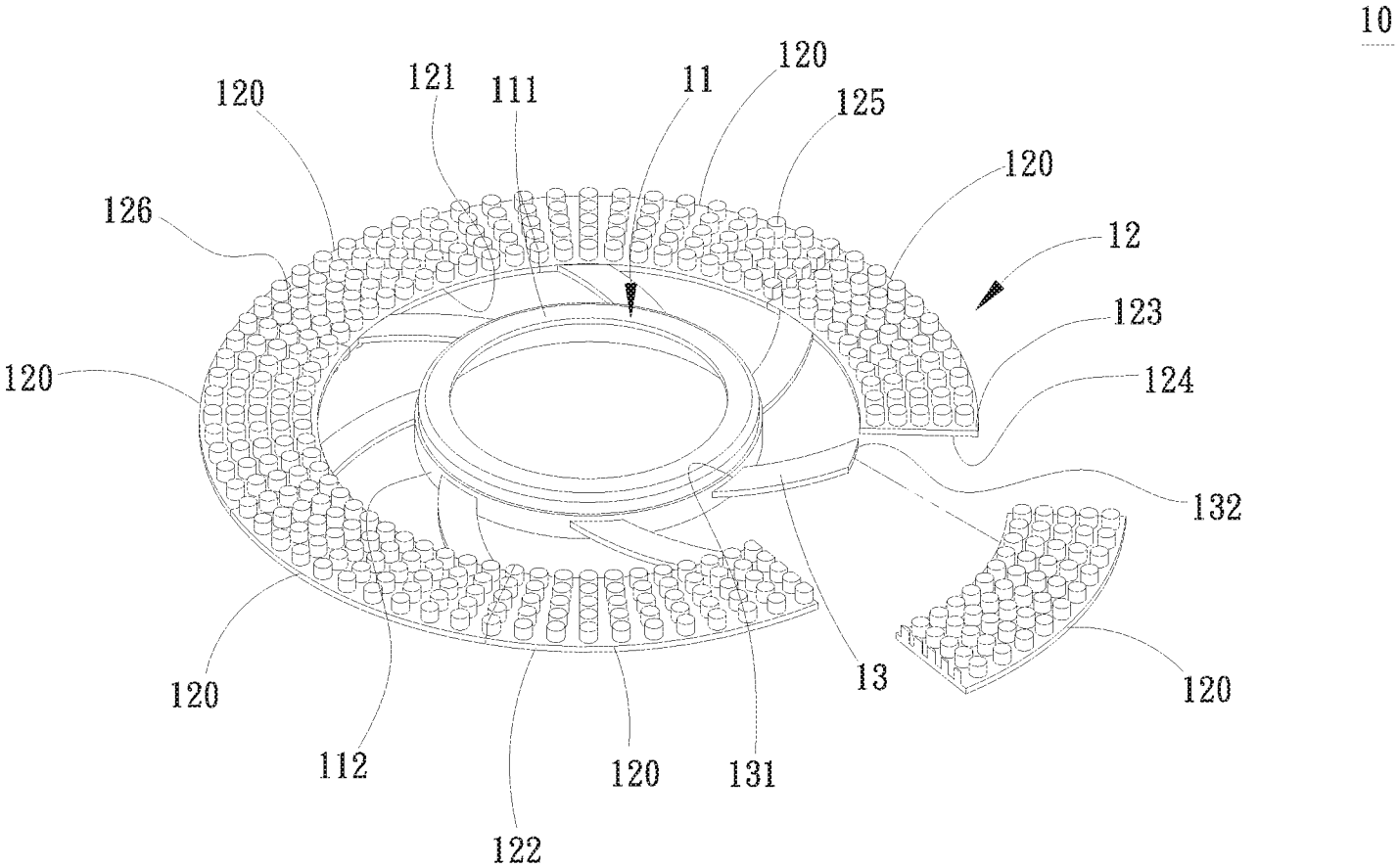

In the above embodiment, the connection members 13 and the plate body 12 are, but not limited to, integrally formed. As shown in FIGS. 7C and 7D, the connection members 13 and the hub 11 are integrally formed. The inner ends 131 of the connection members 13 are integrally connected with the circumferential wall 112 of the hub 11. The outer ends 132 radially extend toward the plate body 12 to connect with the inner rim 121.

Figure 7E:
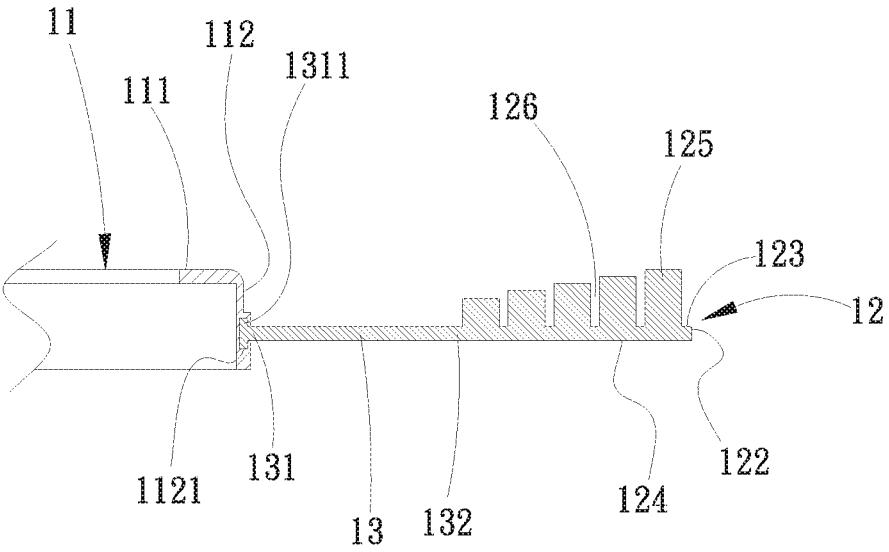
FIGS. 7E and 7F show that the connection members and the plate body or the hub of the present invention are interference-connected with each other.
Figure 7F:
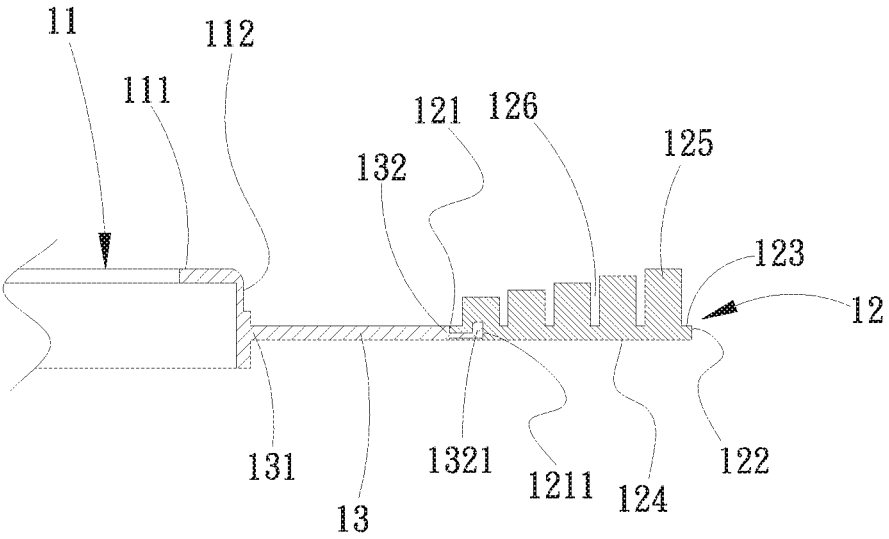

Please further refer to FIGS. 7E and 7F, which show that the connection members and the plate body or the hub of the present invention are interference-connected with each other. As shown in the drawings, the connection members 13 can be connected with the circumferential wall 112 of the hub 11 or the inner rim 121 of the plate body 12 by means of welding, ultrasonic fusion or adhesion. Alternatively, the connection members 13 can be first interference-connected with the circumferential wall 112 of the hub 11 or the inner rim 121 of the plate body 12 and then further connected therewith by means of welding, ultrasonic fusion or adhesion. For example, the circumferential wall 112 of the hub 11 is formed with a cavity 1121 and the inner end 131 of the connection member 13 has an interference section 1311. The interference section 1311 is inserted in the cavity 1121. Alternatively, the inner rim 121 of the plate body 12 is formed with a cavity 1211 and the outer end 132 of the connection member 13 has an interference section 1321. The interference section 1321 is inserted in the cavity 1211.

Figure 8A:
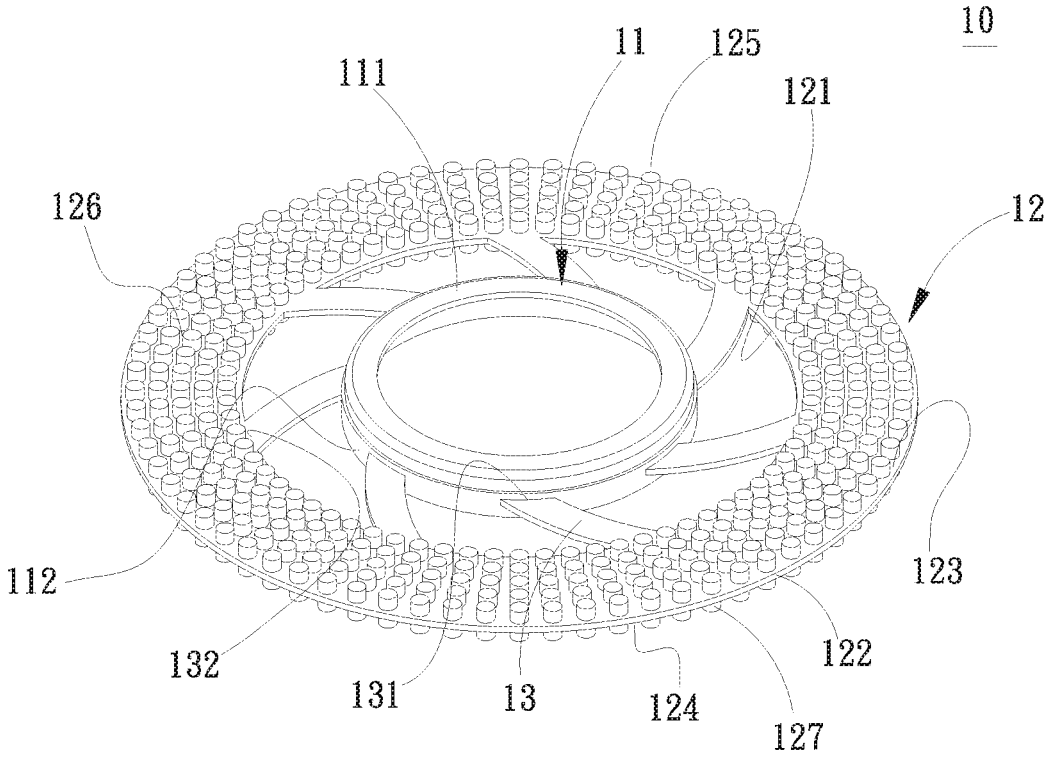
FIGS. 8A to 8C are perspective views showing that multiple lower boss bodies are arranged under the bottom face of the plate body of the present invention.
Figure 8B:
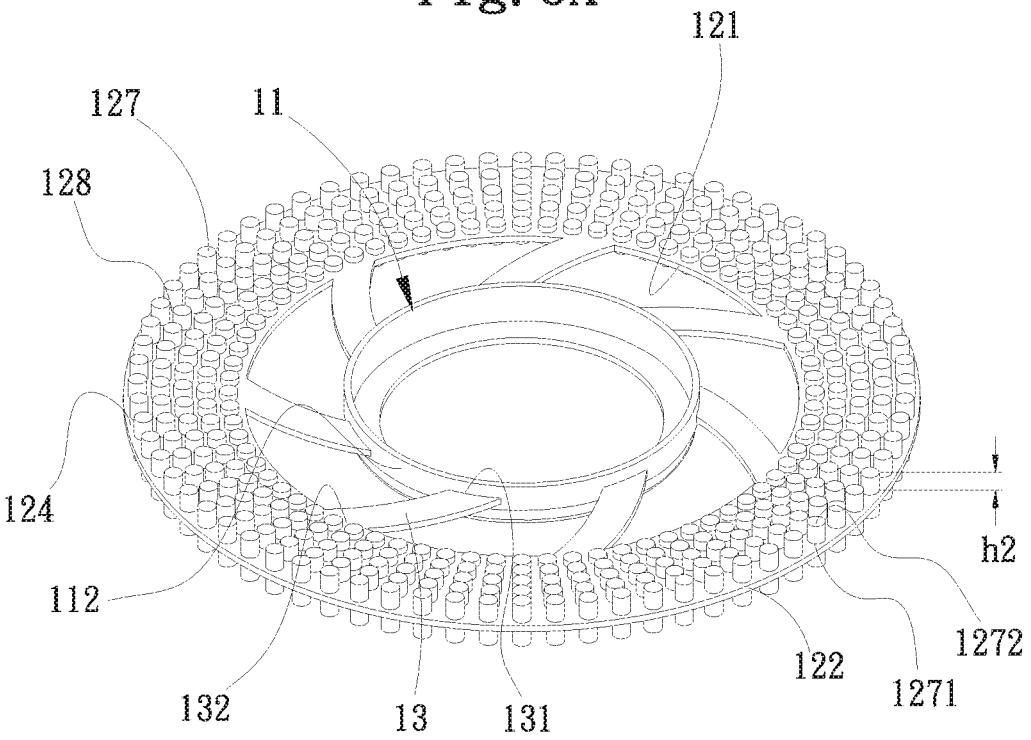
Figure 8D:
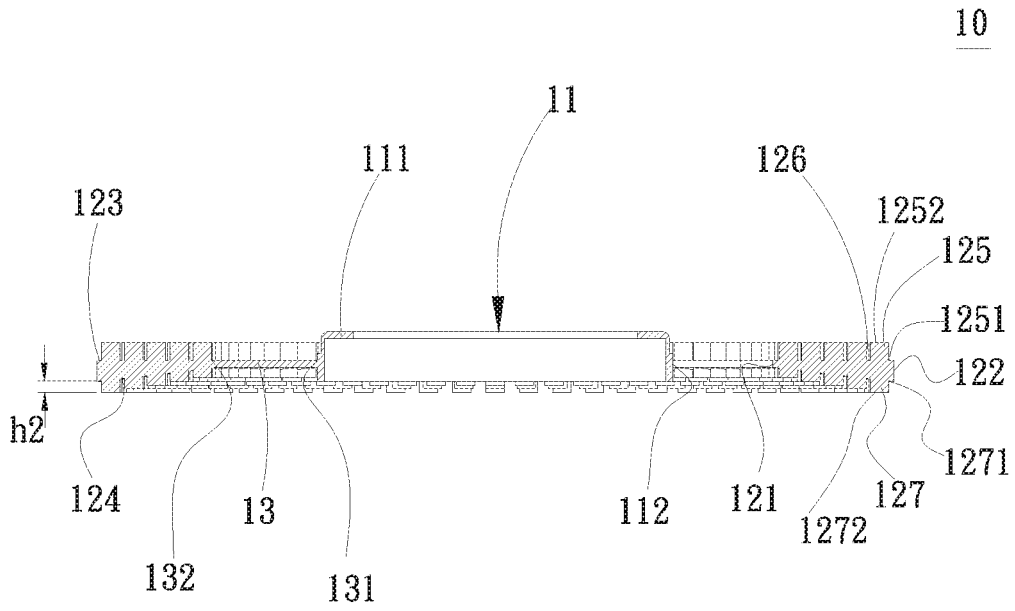
FIGS. 8D and 8E are sectional views showing some other embodiments of the bottom face of the plate body of the present invention.
Figure 8E:
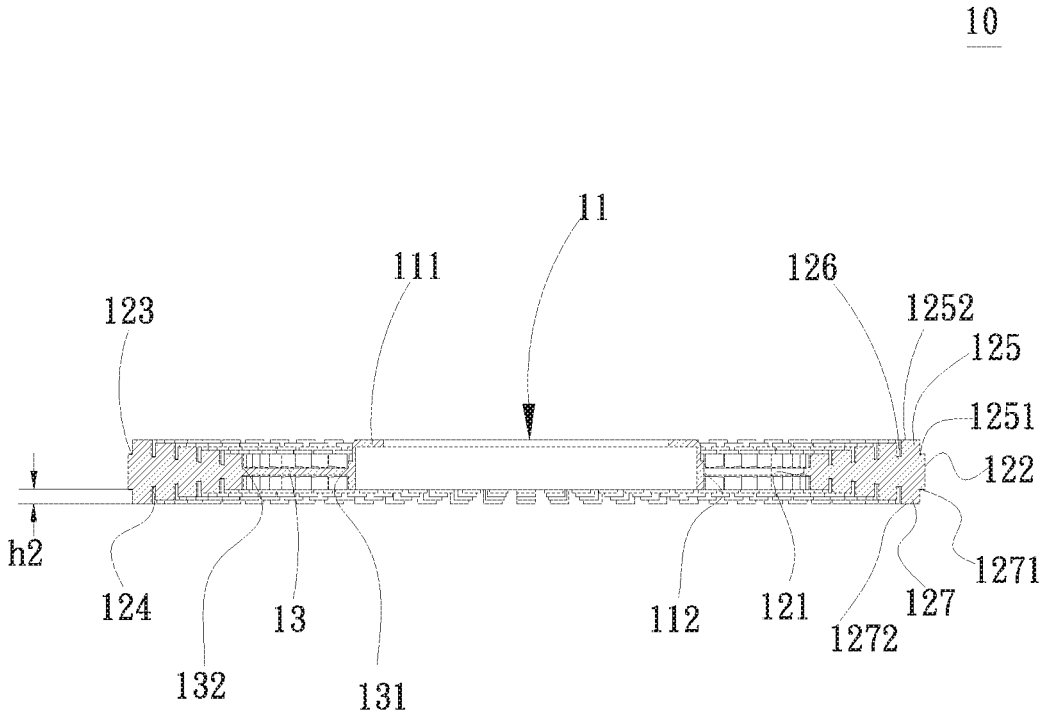
Figure 8C:
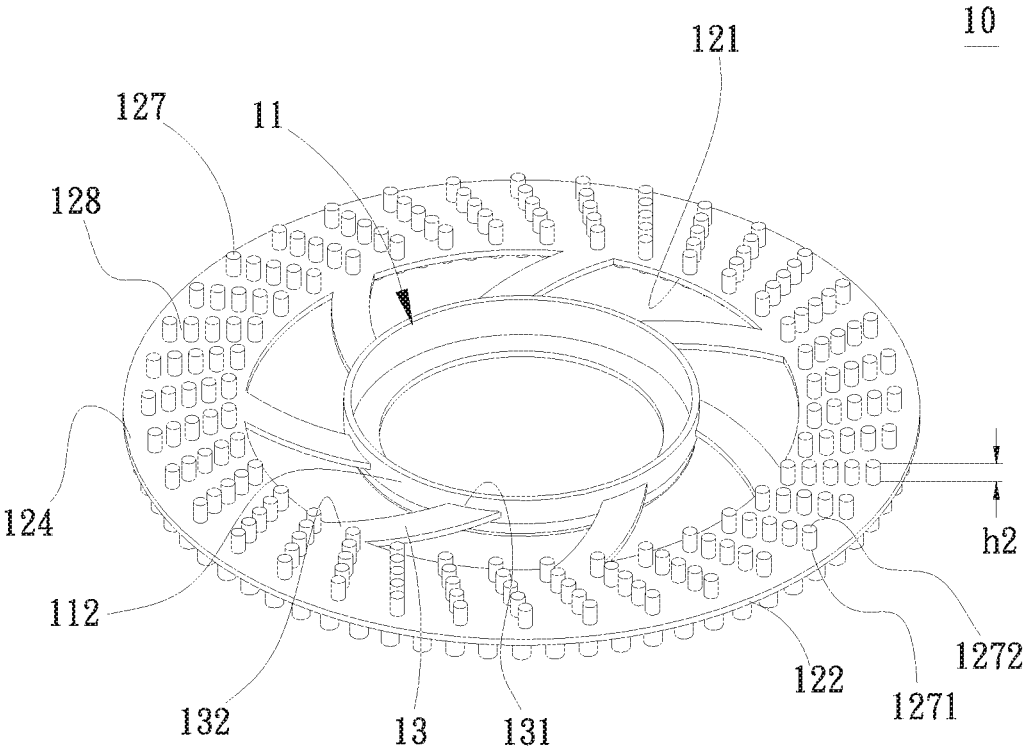

Please further refer to FIGS. 8A, 8B and 8C, which are perspective views showing that multiple lower boss bodies are arranged under the bottom face of the plate body of the present invention. Also referring to FIGS. 1A and 1B, in another embodiment, multiple lower boss bodies 127 are arranged under the bottom face of the plate body 12 at intervals. Multiple second gaps 128 are distributed between the lower boss bodies 127 or around the upper boss bodies 127. Each lower boss body 127 has a second bottom end 1271 and a second free end 1272. The second bottom end 1271 is connected with the bottom face 124. The second free end 1272 downward extends. A second axial height h2 is defined between the second bottom end 1271 and the second free end 1272. The lower boss bodies 127 are identical to the upper boss bodies 125 and thus will not be redundantly described hereinafter. However, it should be noted that the arrangements of the upper boss bodies 125 and the lower boss bodies 127 of the same plate body 12 can be identical. For example, the upper boss bodies 125 and the lower boss bodies 127 are arranged and distributed from the inner rim 121 to the outer rim 122 as multiple concentric circles. The first axial heights h1 and the second axial heights h2 are gradually increased from the inner rim 121 to the outer rim 122 (as shown in FIGS. 8A and 8B). However, in some other embodiments, the arrangements of the upper boss bodies 125 and the lower boss bodies 127 of the same plate body 12 can be different. For example but not limited to, the upper boss bodies 125 are arranged and distributed as multiple concentric circles as shown in FIG. 8A, while the lower boss bodies 127 are arranged and distributed in a radial form.

Please further refer to FIGS. 8D and 8E, which are sectional views showing some other embodiments of the bottom face of the plate body of the present invention. In the above embodiments, the bottom face 124 of the plate body 12 is, but not limited to a plane face. In a modified embodiment, the bottom face 124 of the plate body 12 can be an inclined face, whereby the lower boss bodies 127 are gradually raised from the inner rim 121 to the outer rim 122 (as shown in FIG. 8D). In another embodiment, both the top face 123 and the bottom face 124 of the plate body 12 are inclined faces. The top face 123 and the bottom face 124 are gradually raised from the inner rim 121 to the outer rim 122. In the drawings, the upper boss bodies 125 and the lower boss bodies 127 have the same first axial height h1 and the same second axial height h2. However, this is not limited. This arrangement is also applicable to those embodiments in which the upper boss bodies 125 have different first axial heights h1 and/or the lower boss bodies 127 have different second axial heights h2.

Figure 9:
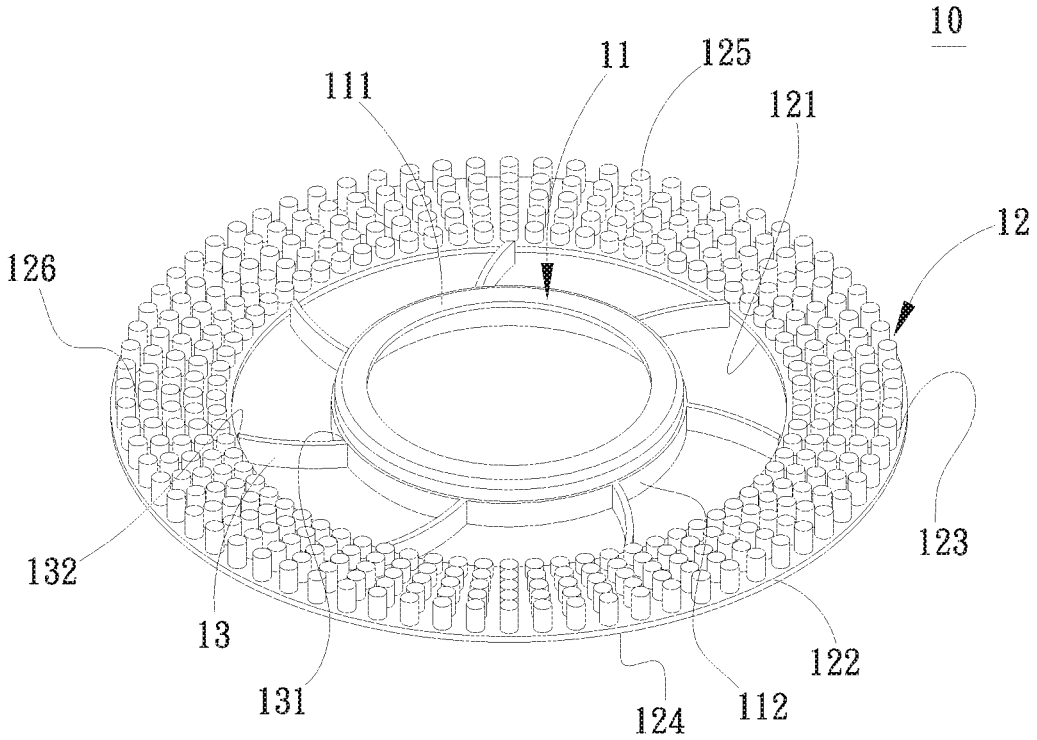
FIG. 9 is a perspective view showing another embodiment of the connection members of the present invention.
Figure 10A:
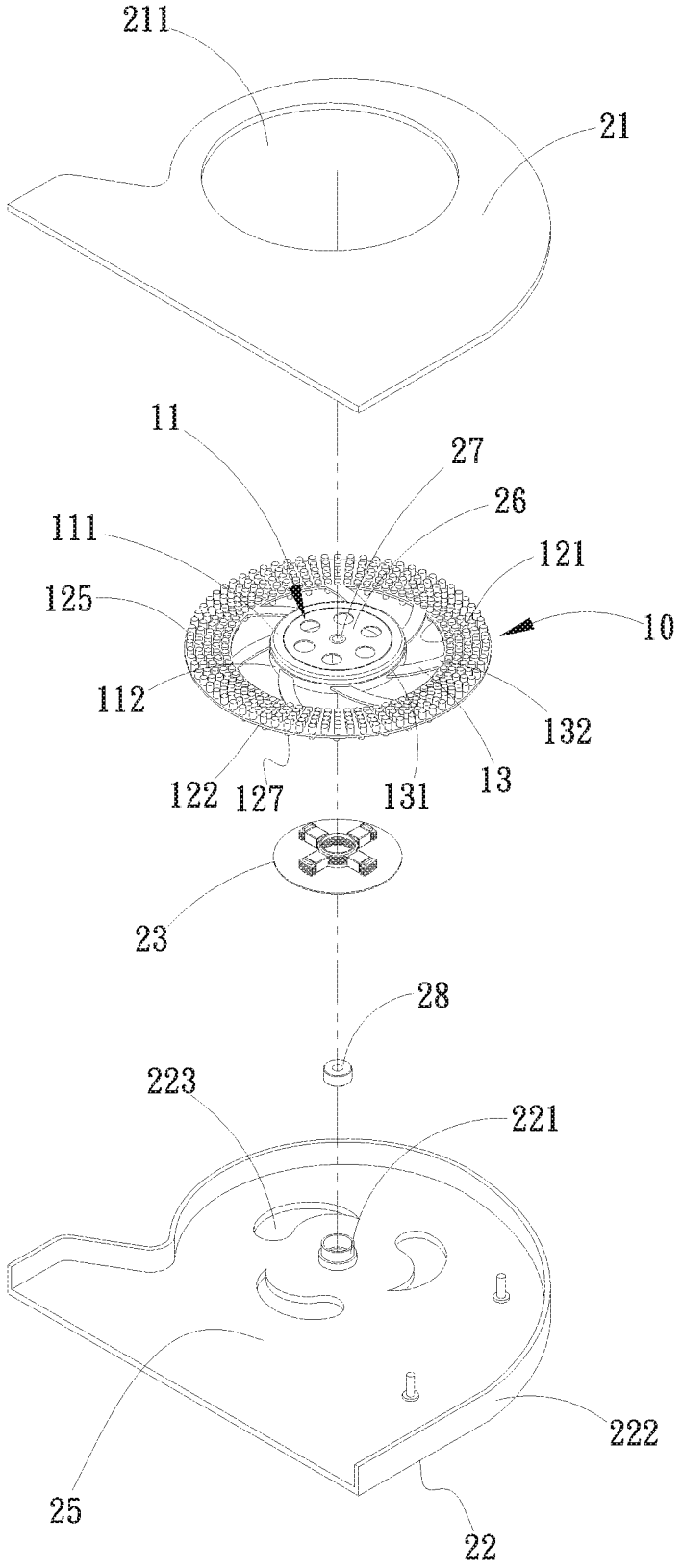
FIGS. 10A and 10B are perspective views showing that the disk-shaped fan impeller structure is disposed in a fan frame.
Figure 10B:
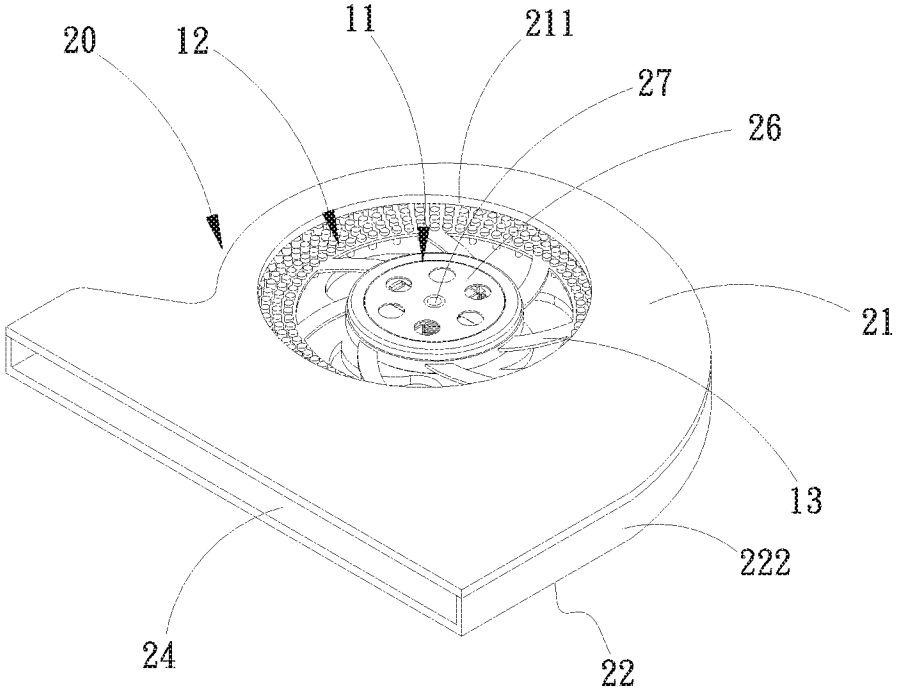

Moreover, in the above embodiments as shown in the drawings, the connection members 13 have the form of ribs to form the disk-shaped fan impeller structure without any blade. However, this is not limited. Please refer to FIG. 9, which is a perspective view showing another embodiment of the connection members of the present invention. As shown in FIG. 9, the connection members 13 have the form of blades. In the drawing, the connection members 13 are centrifugal blades. The connection members 13 and the plate body 12 form a complex disk-shaped fan impeller structure. In this embodiment, some or all of the connection members 13 in the form of centrifugal blades correspond to a wind inlet (as shown in FIGS. 10A and 10B) so as to maintain the fluid intake flow amount. Then the fluid flows through the plate body 12 to lower the periodical noise problem.

Please now refer to FIGS. 10A and 10B, which are perspective views showing that the disk-shaped fan impeller structure is disposed in a fan frame. Also referring to FIGS.

8A to 8C, the fan frame 20 has an upper case 21 and a lower case 22. The upper case 21 has a wind inlet 211. The lower case 22 has a connection seat 221 and a peripheral wall 222. The upper and lower cases 21, 22 define therebetween a wind outlet 24 and a flow way 25. A stator assembly 23 is fitted on the connection seat 221. In addition, multiple windows 223 are selectively formed around the connection seat 221. In the drawings, the peripheral wall 222 is disposed along a peripheral of the lower case 22 and perpendicularly extends to connect with the upper case 21. The flow way 25 communicates with the wind outlet 24.

A rotor assembly 26 (including an iron case and a magnet) and a shaft rod 27 are disposed on the inner face of the hub 11 of the disk-shaped fan impeller 10. The shaft rod 27 is inserted in at least one bearing 28 disposed in the connection seat 221 to support the disk-shaped fan impeller 10 on the connection seat 221. The rotor assembly 26 corresponds to the stator assembly 23. The top wall 111 of the hub 11 and the connection members 13 correspond to the wind inlet 211 of the frame body 20. The diameter of the wind inlet 211 of the frame body 20 is such as but not limited to, larger than the diameter of the top wall 111 of the hub 11.

When the disk-shaped fan impeller 10 rotates, a fluid is driven to flow into the wind inlet 211. The fluid passes through the connection members 13 and then enters the inner rim 121 (or wind inlet side) of the plate body 12. Then the fluid passes through the upper boss bodies 125 and the first gaps 126 to flow out from the outer rim 122 (or wind outlet side). Then the fluid flows through the flow way 25 to flow out from the wind outlet 24. Also, when the disk-shaped fan impeller 10 rotates, the airflow is driven to flow in the windows 223 to pass through the connection members 13 and the inner rim 121 (or wind inlet side) of the plate body 12. Then the airflow passes through the lower boss bodies 127 and the second gaps 128 to flow out from the outer rim 122 (or wind outlet side). Then the airflow flows through the flow way 25 to flow out from the wind outlet 24.

In conclusion, in comparison with the conventional technique, the disk-shaped fan impeller structure 10 of the present invention lowers the periodical noise problem caused by the conventional fan impeller all composed of blades. In addition, the connection members are selectively ribs so that no matter the fan impeller is clockwise rotated or counterclockwise rotated, the disk-shaped fan impeller structure can drive the airflow to flow. In the case that the connection members 13 are selectively blades, the connection members and the plate body form a complex disk-shaped fan impeller structure, whereby the periodical noise problem is lowered and the fluid intake flow amount can be maintained.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A disk-shaped fan impeller structure comprising:

a plate body having an inner rim and an outer rim, multiple connection members being disposed on the inner rim at intervals corresponding to a hub, the plate body being connected with the hub via the connection members, the outer rim extending in a direction away from the hub, the connection members being annularly disposed between the hub and the inner rim of the plate body at intervals in a radial form, a top face and a bottom face being defined between the inner rim and outer rim of the plate body, multiple upper boss bodies being arranged on the top face at intervals and each upper boss body having a free end, multiple first gaps being distributed between the upper boss bodies, and the hub having a top wall being substantially co-planar with the free ends of a plurality of the upper boss bodies.

2. The disk-shaped fan impeller structure as claimed in claim 1, wherein the upper boss bodies are arranged and distributed at equal intervals or unequal intervals.

3. The disk-shaped fan impeller structure as claimed in claim 1, wherein the upper boss bodies and the plate body are integrally formed.

4. The disk-shaped fan impeller structure as claimed in claim 1, wherein the upper boss bodies and the plate body are separate unit bodies connected with each other by a connection means.

5. The disk-shaped fan impeller structure as claimed in claim 1, wherein each upper boss body has a bottom end, a first axial height being defined between the bottom end and the free end.

6. The disk-shaped fan impeller structure as claimed in claim 1, wherein the plate body is one single annular plate body and the plate body, the hub and the connection members being integrally formed or not integrally formed.

7. The disk-shaped fan impeller structure as claimed in claim 1, wherein the plate body includes multiple subsidiary plate body sections, which are assembled to together form an annular plate body.

8. The disk-shaped fan impeller structure as claimed in claim 1, wherein each upper boss body has a cross-sectional form in parallel to the plate body, the cross-sectional forms of the upper boss bodies being identical or different.

9. The disk-shaped fan impeller structure as claimed in claim 8, wherein the cross-sectional form of the upper boss body is a geometrical shape selected from a group consisting of circular shape, quadrilateral shape, triangular shape, elliptic shape, pentagonal shape, hexagonal shape, arched shape, windmill shape and pentagram shape.

10. The disk-shaped fan impeller structure as claimed in claim 1, wherein the upper boss bodies are arranged and distributed in identical pattern or different patterns.

11. The disk-shaped fan impeller structure as claimed in claim 10, wherein the upper boss bodies are arranged and distributed from the inner rim to the outer rim in a radial form or as multiple concentric circles.

12. The disk-shaped fan impeller structure as claimed in claim 10, wherein the upper boss bodies are arranged and distributed from the inner rim to the outer rim in multiple geometrical forms.

13. The disk-shaped fan impeller structure as claimed in claim 1, wherein each upper boss body has a first outer diameter, the first outer diameters of the respective upper boss bodies being equal to or unequal to each other.

14. The disk-shaped fan impeller structure as claimed in claim 13, wherein the first outer diameters of the upper boss bodies are gradually increased or decreased from the inner rim to the outer rim.

15. The disk-shaped fan impeller structure as claimed in claim 1, wherein multiple lower boss bodies are arranged under the bottom face of the plate body at intervals, multiple second gaps being distributed between the lower boss bodies, the bottom face being a plane face or an inclined face.

16. The disk-shaped fan impeller structure as claimed in claim 15, wherein the upper boss bodies and the lower boss bodies are arranged in identical pattern or different patterns.

17. The disk-shaped fan impeller structure as claimed in claim 1, wherein the inner rim forms a wind inlet side and the outer rim forms a wind outlet side, the connection members being ribs or blades, the top face of the plate body being a plane face or an inclined face.

18. A disk-shaped fan impeller structure comprising:

a hub having a top wall and a circumferential wall perpendicularly extending from an outer circumference of the top wall, the top wall corresponding to a wind inlet of a fan frame;

a plate body having an inner rim and an outer rim, the inner rim surrounding and facing the circumferential wall of the hub, the outer rim radially extending in a direction away from the hub, a top face and a bottom face being defined between the inner rim and the outer rim, multiple upper boss bodies being arranged on the top face between the inner rim and the outer rim at intervals, a first gap being defined around each upper boss body, and each upper boss body having a free end, and the free ends of a plurality of the upper boss bodies being substantially co-planar with the top wall of the hub; and multiple connection members disposed between the circumferential wall of the hub and the inner rim of the plate body, the connection members being arranged at intervals in a radial form to radially extend, each connection member having an inner end and an outer end, the inner end being connected with the circumferential wall of the hub, the outer end being connected with the inner rim of the plate body.

19. The disk-shaped fan impeller structure as claimed in claim 18, wherein multiple lower boss bodies are arranged under the bottom face at intervals, a second gap being defined around each lower boss body.

20. The disk-shaped fan impeller structure as claimed in claim 19, wherein the upper boss bodies and the lower boss bodies are arranged in identical pattern or different patterns.

21. The disk-shaped fan impeller structure as claimed in claim 18, wherein the inner rim forms a wind inlet side and the outer rim forms a wind outlet side.

22. The disk-shaped fan impeller structure as claimed in claim 18, wherein the multiple connection members radially extend from the hub to the plate body or radially extend from the plate body to the hub.

23. A disk-shaped fan impeller structure disposed in a fan frame, the fan frame having a wind inlet and a wind outlet, the disk-shaped fan impeller structure comprising:

a hub corresponding to the wind inlet of the fan frame, the hub having a top wall and multiple connection members, the connection members extending in a direction away from the hub to form an outer end; and a plate body surrounding the connection members and connected with the outer ends of the connection members, multiple upper boss bodies and multiple first gaps being arranged on one face of the plate body, the first gaps being distributed around the upper boss bodies to space the adjacent upper boss bodies, and each upper boss body having a free end, and the free ends of a plurality of the upper boss bodies being substantially co-planar with the top wall of the hub, an airflow flowing from the wind inlet into the fan frame to flow through the connection members and the plate body and then flow out of the fan frame from the wind outlet.

24. The disk-shaped fan impeller structure as claimed in claim 23, wherein multiple lower boss bodies and multiple second gaps are arranged on the other face of the plate body, the second gaps being distributed around the lower boss bodies to space the adjacent lower boss bodies.

25. The disk-shaped fan impeller structure as claimed in claim 24, wherein the upper boss bodies and the lower boss bodies are arranged in identical pattern or different patterns.

* * * * *